US007766760B2

(12) United States Patent
Priester et al.

(10) Patent No.: US 7,766,760 B2
(45) Date of Patent: Aug. 3, 2010

(54) MUSCLE TRAINING APPARATUS AND METHOD

(76) Inventors: William B. Priester, 14 Deepwood, Jackson, TN (US) 38305; Richard E. May, 2732 Altadena Rd., Birmingham, AL (US) 35243

( * ) Notice: Subject to any disclaimer, the term of this patent is extended or adjusted under 35 U.S.C. 154(b) by 346 days.

(21) Appl. No.: 11/857,049

(22) Filed: Sep. 18, 2007

(65) Prior Publication Data

US 2009/0131191 A1 May 21, 2009

Related U.S. Application Data

(63) Continuation-in-part of application No. 10/681,971, filed on Oct. 9, 2003, now Pat. No. 7,351,157.

(51) Int. Cl.
*A63B 69/36* (2006.01)

(52) U.S. Cl. ..... 473/228; 473/226

(58) Field of Classification Search ..... 473/223, 473/226, 228, 437, 457, 451
See application file for complete search history.

(56) References Cited

U.S. PATENT DOCUMENTS

| | | | |
|---|---|---|---|
| 1,712,537 | A | 5/1929 | White |
| 2,482,015 | A | 9/1949 | McConnell |
| 2,804,306 | A | 8/1957 | Chedister et al. |
| 2,910,297 | A | 10/1959 | Bonetate |
| 3,565,444 | A | 2/1971 | LaRocca |
| 3,758,117 | A | 9/1973 | Harrison |
| 3,809,397 | A | 5/1974 | Gruenewald |
| 3,829,102 | A | 8/1974 | Harrison |
| 3,997,115 | A | 12/1976 | Licudine |
| 4,017,083 | A | 4/1977 | Johnson |
| 4,379,552 | A | 4/1983 | Webb et al. |
| 4,576,378 | A | 3/1986 | Backus |
| 4,907,800 | A | 3/1990 | Passamaneck |
| 5,096,199 | A | 3/1992 | Wyatt, Jr. et al. |
| 5,100,148 | A | 3/1992 | Smith |
| 5,143,376 | A | 9/1992 | Johnson |
| 5,165,683 | A | 11/1992 | Beutler et al. |
| 5,184,825 | A | 2/1993 | Ruth |
| 5,209,482 | A | 5/1993 | Hopfer |
| 5,236,192 | A | 8/1993 | Pitzel |
| 5,338,035 | A | 8/1994 | Lyford |
| 5,362,059 | A | 11/1994 | Grossman |
| 5,435,696 | A | 7/1995 | Cunning |
| 5,456,650 | A | 10/1995 | Williams, Jr. et al. |
| 5,571,048 | A | 11/1996 | Kenney |
| 5,613,915 | A | 3/1997 | Van Alen, Jr. |
| 5,634,857 | A | 6/1997 | Bradshaw et al. |
| 5,845,885 | A | 12/1998 | Carnevali |

(Continued)

*Primary Examiner*—Nini Legesse
(74) *Attorney, Agent, or Firm*—Luedeka, Neely & Graham, P.C.

(57) ABSTRACT

The invention is directed to a muscle trainer for exercising opposing muscles of a person moving an implement, such as a golf club, wherein, if the opposing muscles were of appropriate strength, the opposing muscles would desirably apply forces in opposite directions to the implement to assist in maintaining an ideal movement of the implement. The contemplated muscle trainer of this invention includes a body and a force generator positioned at a prescribed location on the body for urging the body in a direction away from a force direction which a weaker set of the opposing muscles would normally apply to the implement in the movement of the implement by the person.

24 Claims, 14 Drawing Sheets

U.S. PATENT DOCUMENTS 5,971,828 A 10/1999 Lin
5,971,864 A 10/1999 Joshi et al.
D416,081 S 11/1999 Lee
6,079,949 A 6/2000 Litvin
6,238,299 B1 5/2001 Barnette
6,533,551 B2 3/2003 Escobar
6,851,933 B2 2/2005 Cortez

MUSCLE TRAINING APPARATUS AND METHOD

This application claims priority as a continuation-in-part to copending U.S. patent application Ser. No. 10/681,971 filed Oct. 9, 2003 now U.S. Pat. No. 7,351,157 titled "Muscle Training Apparatus Method," the entire contents of which are incorporated herein by reference.

FIELD

This invention relates to a muscle trainer and to methods of exercising a muscle. This invention particularly relates to a muscle trainer for use by an individual when exercising one or more muscles used to swing an implement, and/or when exercising one or more muscles used to rotate the implement, and to methods of exercising such muscles.

BACKGROUND OF THE INVENTION

Many types of activities require an individual to swing an implement in an attempt to successfully accomplish the end goal of participation in such activity. For example, when participating in any of several sporting games, an individual may be required to swing any of several different implements, each of which is unique to a particular one of the games. Examples of such implements include a bat in the games of baseball and softball, a racket used in the games of tennis and racket ball, and a club used in the game of golf. The swinging of an implement is also required in certain non-sports or work environments such as, for example, the swinging of a maul, a hammer or an axe.

In any of the above-noted activities, an efficient and desired end result may be achieved from the swinging of the implement when the implement is swung in an ideal path. The ideal path will vary depending on the individual's height, build and flexibility. When an individual swings the implement in that individual's ideal path, various muscle groups must function together in a precise way. The need for muscular precision is particularly apparent in the game of golf, where the implement is a golf club and the individual is a golfer. If the individual is aligned properly and is swinging the implement at the proper speed along the ideal path, the end result will also be ideal.

In the game of golf, the golf club includes a metal or non-metal-composite shaft having a club head attached to one end of the shaft and a gripping material, referred to as "the grip," attached to the other end of the shaft. Another component of the game of golf is a golf ball. The general object of the game is for the golfer, by use of the club, to cause the ball to be moved typically from an earthen mound, referred to as "the tee," toward and into a small container, referred to as "the cup", which is located in a carpet of short grass, referred to as "the green", typically several hundred yards from the tee.

The golfer causes the ball to be moved generally by (1) grasping the grip of the club with both hands, (2) "addressing" the ball with the club head which includes aligning "a sweet spot" of a front, or ball-impact, face of the club head with the ball, (3) raising the club, desirably through the ideal path, in a motion referred to as "the backswing", (4) locating the shaft of the club, upon completion of the backswing, in a transitional position behind the head of the golfer, (5) swinging the club forward from the transitional position, desirably returning through the ideal path, in a momentum-gathering motion referred to as "the downswing" and, desirably, (6) directing the sweet spot of the front face of the club head into impact-engagement with the ball to drive the ball along a desired trajectory and direction, leading to eventual placement of the ball in the cup.

The combined motions of the backswing and the downswing are referred to as "a stroke." Typically, several strokes by the golfer are required to advance the ball along a path, commonly referred to as "the fairway," between the tee and the green, and to its ultimate destination in the cup.

When the golfer addresses the ball with the ball-impacting front face of the club head (hereinafter referred to as the club face), the sweet spot of the club face is adjacent and aligned with the ball as noted above. As the golfer begins the backswing, the club head is moved through an arc away from the ball, but desirably maintains an initial arcing alignment between the club face and the ball. At some point during the initial segment of the backswing, there is anatomical/mechanical necessity for some degree of rotation of the club shaft such that the club face loses its arcing alignment with the ball. As the golfer swings the club through the downswing of the stroke, the golfer must effectively rotate the club in the reverse direction, preferably just before impact with the ball, to return the club face to arcing alignment with the ball.

Desirably, following movement of the club through the full stroke, the golfer should have returned the club face through the ideal path to the addressed position with the momentum necessary to effectively strike and carry the ball in a desired trajectory and direction.

While it is a practical impossibility to accomplish a "perfect" golf swing each and every time a golfer swings the club to impact the ball, several professional golfers seem to accomplish a near "perfect" swing on a reasonably consistent basis. In attempts to bring some semblance of a near "perfect" swing to at least non-professional golfers, techniques have been developed to train the swinging muscles of a golfer with a goal of developing muscle memory to provide a more consistent and efficient golf swing. Even so, there remains a need for a device and methods which will better enable the golfer, or any one swinging an implement, to swing the club or other implement along an ideal path.

SUMMARY OF THE INVENTION

The above and other needs are met by a muscle trainer and methods which contemplate that when an individual swings an implement along a path, a first muscle or set of muscles exerts a pulling force on the swinging implement in a first direction generally laterally of the ideal path. At the same time, a second muscle or set of muscles exerts a pulling force on the swinging implement in a second direction generally laterally of the ideal path and generally in a direction which is opposite to the first direction. If the first and second muscles or sets of muscles are of equal strength, the opposing pulling forces exerted upon the implement tend to maintain the implement in an ideal path to achieve the ideal end result in an efficient and desirable manner.

As used hereinafter, the word "muscle" can mean a single muscle, a set of muscles, or both.

When swinging the implement, if the first muscle is stronger than the second muscle, the first muscle will dominate the weaker second muscle to the extent that the implement is pulled laterally away from the ideal path in the first direction, whereby the individual is not swinging the implement in the most efficient manner to accomplish the task at hand. This undesirable dominant-muscle condition and its attendant disadvantages are particularly apparent in sporting games such as, for example, the game of golf, where the implement is a golf club and the individual is a golfer.

One of the primary goals in golf involves achieving an ideal plane of the swing of the golf club. The ideal backswing plane has been described as being like a sheet of glass resting on the golfer's shoulders and extending to the golf ball. Producing the ideal downswing plane requires that the sheet of glass is shifted to a flatter angle and is skewed for a more inside to outside club shaft path. To achieve these ideal planes, the path that the club shaft must follow during the swing must be an ideal one. However, the ideal club shaft path does not typically coincide with a true plane like a sheet of glass. The non-planar nature of the ideal club shaft path is more apparent in the backswing, in which the ideal club shaft path has been described as having a significant upward curvature.

In an attempt to marry these conflicting visual images of curves and planes, the term "club shaft plane" will hereinafter be used in preference to the terms club shaft path and swing plane. As mentioned above, it would be very difficult, if not impossible, for a human being to swing a golf club through a complete stroke while keeping the club shaft in one club shaft plane which is a true plane. Hence, it is correct to state that the path in which the club shaft travels is not typically a true plane. The club shaft plane, as that phrase is used herein, refers to a composite of an infinite number of planes existing in a tangential relationship to the path of the club shaft. The ideal club shaft plane will be different for each golfer depending on the golfer's height, build, and flexibility.

To best visualize the club shaft plane, observation of the golfer's swing should take place from a position looking down the target line on the takeaway side of the golfer's swing. From this perspective, a common error is for the golfer to allow the club shaft to deviate behind or in front of their ideal club shaft plane. To achieve the result of keeping the club shaft within the ideal club shaft plane, a group of opposing muscles in the golfer's torso, shoulders, arms, and hands must function in a proper manner. This muscle group is referred to as the "club shaft plane opposing muscle group". The two sets of opposing muscles within the club shaft plane opposing group are the "behind-the-plane muscles" and the "front-of-the-plane muscles". One could consider these two sets of opposing muscles as being in a tug-of-war, pulling against each other to determine the actual club shaft plane. Ideally then, these two sets of muscles should be of appropriate strength, such that neither set dominates the other set, and the shaft of the club is maintained within, and is not moved laterally from, the ideal club shaft plane.

To better represent the movement of the entire golf club in space, the position of the club face will hereinafter be referred to as the club face plane. Regardless of the loft of the club face, the club face plane represents the position of the club face as if the club face had zero degrees of loft. Unlike the club shaft plane which typically has some degree of curvature, the club face plane is a true plane since it is an extension of the zero degree club face. The concepts of the club face plane and the club shaft plane help one to visualize the relationship between the movement of the club face and the club shaft during the golf swing. The proper relationship between these two planes is captured in a "two-plane-merger" golf swing theory.

The tug-of-war between the behind-the-plane muscles and the front-of-the-plane muscles is accompanied by the anatomical/mechanical need for rotation of the shaft and club face plane during the swing. The two-plane-merger theory can be explained by the following discussion of swing positions.

At the address, or six o'clock, position, the club face plane is ideally a vertical plane which is essentially perpendicular to the club shaft plane. In a face-to-face perspective while observing the swing of a right handed golfer, the club face plane is rotated in a counter-clockwise direction about the axis of the club shaft to achieve a mechanically efficient movement in which the club face plane "slices" through the air in an aerodynamic fashion. Ideally, somewhere between the eight o'clock and ten o'clock backswing positions, the club face plane has been rotated ninety degrees in a counter-clockwise direction so that the club face plane "merges", and is substantially "co-planar", with the club shaft plane. This ideal ninety degree rotation creates what is referred to as the "merged position". At the backswing completion position and during the downswing, the club face plane should remain merged with the club shaft plane until just before impact when the club face plane is rotated ninety degrees in a clockwise direction to achieve a "square" impact position which is perpendicular to the club shaft plane. The relationship of the club face plane and the club shaft plane during the follow-through should approximate the mirror image of the relationship of the two planes during the backswing with a remerger of the two planes occurring between the four o'clock and six o'clock positions. This action defines proper execution of the two-plane-merger golf swing theory.

The rotation of the club shaft and the club face plane to bring about two-plane-merger utilizes a group of opposing muscles in the arms and hands referred to as the "rotational opposing muscle group". With an observer in a face-to-face perspective with a right handed or left handed golfer, the two sets of opposing muscles in the rotational opposing muscle group are referred to as the "counter-clockwise rotational muscles" and the "clockwise rotational muscles". The counter-clockwise rotational muscles move the club face plane in counter-clockwise direction, such that if the face-to-face observer were looking at the clubface plane as the hand on a clock, it would be moving from 12:00 towards 9:00. It follows that, in the same perspective, the clockwise muscles move the club face plane from 12:00 towards 3:00.

In the two-plane-merger theory, over action of either set of opposing rotational muscles will result in "demerged errors". These demerged errors occur when the rotation of club face plane rotation is either greater or less than ninety degrees.

During the backswing of a right handed golfer, over action of the counter-clockwise rotational muscles will result in an angle of rotation of the club face plane of greater than ninety degrees and an "open" club face position. Over action of the clockwise rotational muscles will result in an angle of rotation of the club face plane of less than ninety degrees and a "shut" or "closed" club face position.

During the backswing of a left handed golfer, over action of the clockwise rotational muscles will result in an angle of rotation of the club face plane of greater than ninety degrees and an open club face position. Over action of the counter clockwise rotational muscles will result in an angle of rotation of the club face plane of less than ninety degrees and a shut or closed club face position.

A third group of opposing muscles in the arms and hands controls the hinging movement of the club during the swing. This group of opposing muscles is referred to as the "hinge opposing muscle group" and is composed of two sets of opposing muscles, the "hinge loading muscles" and the "hinge releasing muscles".

In a face-to-face perspective with a right handed or left handed golfer, the hinge opposing muscle group can be isolated by elevating and lowering the head of the club within the vertical club face plane at the six o'clock address position. While keeping the arms and the rest of the body in relatively fixed position, maximal elevation of the club head without rotation of the club face plane demonstrates maximum and isolated function of the hinge loading muscles. Returning the maximally elevated club head to the six o'clock address position without rotation of the club face plane similarly demonstrates maximum and isolated function of the hinge releasing muscles.

For a right handed golfer, the hinge angle is the angle between the club shaft and the left forearm. For a left handed golfer, the hinge angle is the angle between the club shaft and the right forearm. Professional golfers will intentionally vary the change in their hinge angle depending on the type of shot they are playing. Given that professional golfers will frequently flatten their downswing club shaft plane in relation to their backswing club shaft plane, it is incorrect to assume that the address hinge angle will be identical to the impact hinge angle.

To illustrate hinge errors, the intentional change in the hinge angle during the backswing will be arbitrarily set at ninety degrees. An under loaded hinge error occurs during the backswing when the change in the hinge angle is less than ninety degrees. An over loaded hinge error occurs during the backswing when the change in the hinge angle is greater than ninety degrees.

An early release of the hinge angle error during the downswing occurs when the golfer allows the hinge angle to begin decreasing before the club shaft approaches a horizontal position relative to the ground. This is one of the most common errors in golf and is referred to as "casting". This power wasting error is called casting because the motion resembles what a fisherman intentionally does with his wrists when casting the end of his fishing line towards a landing spot target. Casting is definitely the most common and swing-disrupting hinging error. A late release of the hinge angle error during the downswing occurs when the golfer does not allow the hinge angle to begin decreasing at the appropriate hinge release point. This is a very uncommon error.

An under released hinge angle error occurs during the downswing when the golfer does not allow the hinge angle to decrease to the ideal impact hinge angle. This error plays a role in hitting "thin" shots and "topped" shots. A thin shot occurs when ball is struck at a place below the "sweet spot". The sweet spot is the ideal point of impact on the club face. A topped shot occurs when the lower edge of the club face strikes the ball above its equator, resulting in a downward trajectory of the ball into the ground. An over released hinge angle error occurs during the downswing when the golfer allows the hinge angle to decrease beyond the ideal impact hinge angle. This error plays a role in hitting "fat" shots. A fat shot occurs when the lower edge of the club face strikes the ground before the club face contacts the ball.

Other crucial variables associated with the swing include arc and speed. The arc refers to the path of the club head and is determined by the amount of extension of the hands away from the golfer's body, the timing of the golfer's hinge, the amount of shoulder turn, and the amount of hip turn by the golfer. The speed of the backswing is typically slower than the speed of the downswing. Variation in the speed of the swing and the timing of the transition between the backswing and downswing create the tempo of the swing. The arc and speed variables are much easier to manipulate and manage once the golfer has acquired the proper muscle memory for their ideal club shaft plane, ideal two-plane merger, and ideal hinging.

The exercising and improvement of memory patterns of opposing muscle groups, such as, for example, the three opposing muscle groups described above, can be accomplished by working the various sets of opposing muscles through motions which are akin to the motions typically utilized when swinging a golf club in the normal fashion. If the dominant, or stronger, set of opposing muscles is exercised to the same extent as the dominated, or weaker, set of opposing muscles, any strength imbalance between the two sets of opposing muscles will be undesirably maintained. If the dominated set of opposing muscles is exercised solely in an effort to bring the strength level thereof in line with the dominating set of opposing muscles, then the dominating muscles would tend to lose muscle tone, and the desired memory patterns of the two sets of opposing muscles would be difficult, if not impossible, to attain.

Thus, there is a need for a muscle trainer, and methods of exercising, which will provide simultaneous sustained exercising of sets of opposing muscles leading to the development of desired memory patterns, while, at the same time, processing the dominated set of opposing muscles through a more strenuous exercise program, to eventually provide balanced muscle strength of the sets of opposing muscles.

The contemplated muscle trainer of this invention includes a body having a grip surface located thereon, and at least one force generator positioned at a prescribed location on the body, which is spaced from the grip surface, for urging the prescribed location of the body in a direction away from a force direction which the weaker muscle would normally apply to the implement in the swinging thereof by the person.

This invention further contemplates a muscle trainer including a body having a proximal end and a distal end spaced from the proximal end. A grip portion is formed on the body closer to the proximal end than to the distal end thereof. At least one force generator is located on the body, closer to the distal end than to the proximal end, and positioned for urging the distal end of the body in a direction away from the force direction which the weaker muscle would normally apply to the implement in the swinging thereof.

In addition, this invention contemplates a muscle trainer including a body having a proximal end and a distal end spaced from the proximal end. A grip portion is formed on the body closer to the proximal end than to the distal end thereof. At least one motor is located on the body, and a propeller is attached to the motor in such a position that, upon operation of the motor, the propeller is operated to urge the distal end of the body in the direction away from the force direction which the weaker muscle would normally apply to the muscle trainer in the swinging thereof.

Further, this invention contemplates a method by which a golfer exercises at least a non-dominating club shaft plane muscle of two opposing club shaft plane muscles typically used by the golfer when attempting to swing a golf club in an ideal club shaft plane, where the non-dominating club shaft plane muscle applies a non-dominating swing force to the golf club in a non-dominating swing force direction, and a dominating club shaft plane muscle applies a dominating swing force in a dominating swing force direction to the golf club which is opposite the non-dominating swing force direction, and exceeds the non-dominating swing force.

The method contemplated by this invention includes the steps of swinging a golf club or a golf club simulator in a club shaft plane normally generated by the golfer, determining whether the actual club shaft plane is outside of an ideal club shaft plane due to the non-dominating club shaft plane muscle allowing the dominating club shaft plane muscle to pull the golf club simulator in the dominating swing force direction away from the ideal club shaft plane, applying an external force to the golf-club simulator independently of any force applied by the golfer to further urge the simulator in the dominating swing force direction, and using the non-dominating club shaft plane muscle to pull the golf-club simulator against the external force in the non-dominating swing force direction toward the ideal club shaft plane, thereby exercising the non-dominating club shaft plane muscle in a more strenuous fashion than the dominating club shaft plane muscle to eventually provide balanced muscle strength of the two opposing muscles.

Further, this invention contemplates a method by which a golfer exercises at least a non-dominating rotational muscle of two opposing rotational muscles typically used by a golfer when attempting to swing a golf club with ideal two-plane-merger, where the non-dominating rotational muscle applies a non-dominating rotational force to the golf club in a non-dominating rotational force direction, and a dominating rotational muscle applies a dominating rotational force in a dominating rotational force direction to the golf club which is opposite the non-dominating rotational force direction, and exceeds the non-dominating rotational force.

The method contemplated by this invention includes the steps of swinging a golf club or a golf club simulator with the two-plane relationship normally generated by the golfer, determining whether the actual two-plane relationship is outside of the ideal two-plane merger relationship due to the non-dominating rotational muscle allowing the dominating rotational muscle to rotate the club face plane in the dominating rotational direction away from ideal two-plane merger, applying an external force to the golf-club simulator independently of any force applied by the golfer to further urge the simulator in the dominating rotational direction, and using the non-dominating rotational muscle to rotate the golf club simulator against the external force in the non-dominating rotational direction toward ideal two-plane merger, thereby exercising the non-dominating rotational muscle in a more strenuous fashion than the dominating rotational muscle to eventually provide balanced muscle strength of the two opposing rotational muscles.

Further, this invention contemplates a method by which a golfer exercises at least a non-dominating hinge muscle of two opposing hinge muscles typically used by a golfer when attempting to swing a golf club with an ideal hinge motion, where the non-dominating hinge muscle applies a non-dominating hinge force to the golf club in a non-dominating hinge force direction, and a dominating hinge muscle applies a dominating hinge force to the golf club which is opposite the non-dominating hinge force direction, and exceeds the non-dominating hinge force.

The method contemplated by this invention includes the steps of swinging a golf club or a golf club simulator with the hinge motion normally generated by the golfer, determining whether the actual hinge motion is different from the ideal hinge motion due to the non-dominating hinge muscle allowing the dominating hinge muscle to hinge the club in a dominating hinge force direction away from the ideal hinge motion, applying an external force to the golf club simulator independently of any force applied by the golfer to further urge the simulator in the dominating hinge direction, and using the non-dominating hinge muscle to hinge the golf club simulator against the external force in the non-dominating hinge direction toward ideal hinge motion, thereby exercising the non-dominating hinge muscle in a more strenuous fashion than the dominating hinge muscle to eventually provide balanced muscle strength of the two muscles.

Further, this invention contemplates a method by which a golfer exercises the club shaft plane opposing muscle group, the rotational opposing muscle group and the hinge opposing muscle group in a simultaneous fashion.

In another aspect, the present invention provides a method of exercising two human-anatomy muscles which typically oppose one another in the performance of a prescribed task. The method comprises the steps of exercising, at a prescribed level, the stronger muscle of the two muscles, and simultaneously with the exercising of the stronger muscle, exercising the weaker muscle of the two muscles at a level greater than the prescribed level.

In yet another aspect, the invention provides a method of exercising a group containing two sets of human-anatomy muscles, where the two sets of muscles typically oppose one another in the performance of a prescribed task. The method comprises the steps of exercising, at a prescribed level, the stronger of the two sets of muscles, and simultaneously with the exercising of the stronger of the two sets of muscles, exercising the weaker of the two sets of muscles at a level greater than the prescribed level.

BRIEF DESCRIPTION OF THE DRAWINGS

Further advantages of the invention are apparent by reference to the detailed description considered in conjunction with the figures, which are not to scale so as to more clearly show the details, wherein like reference numbers indicate like elements throughout the several views, and wherein:

FIG. 13 is a bottom perspective view showing the muscle trainer of FIG. 12;

DETAILED DESCRIPTION OF PREFERRED EMBODIMENTS OF THE INVENTION

Figure 1:
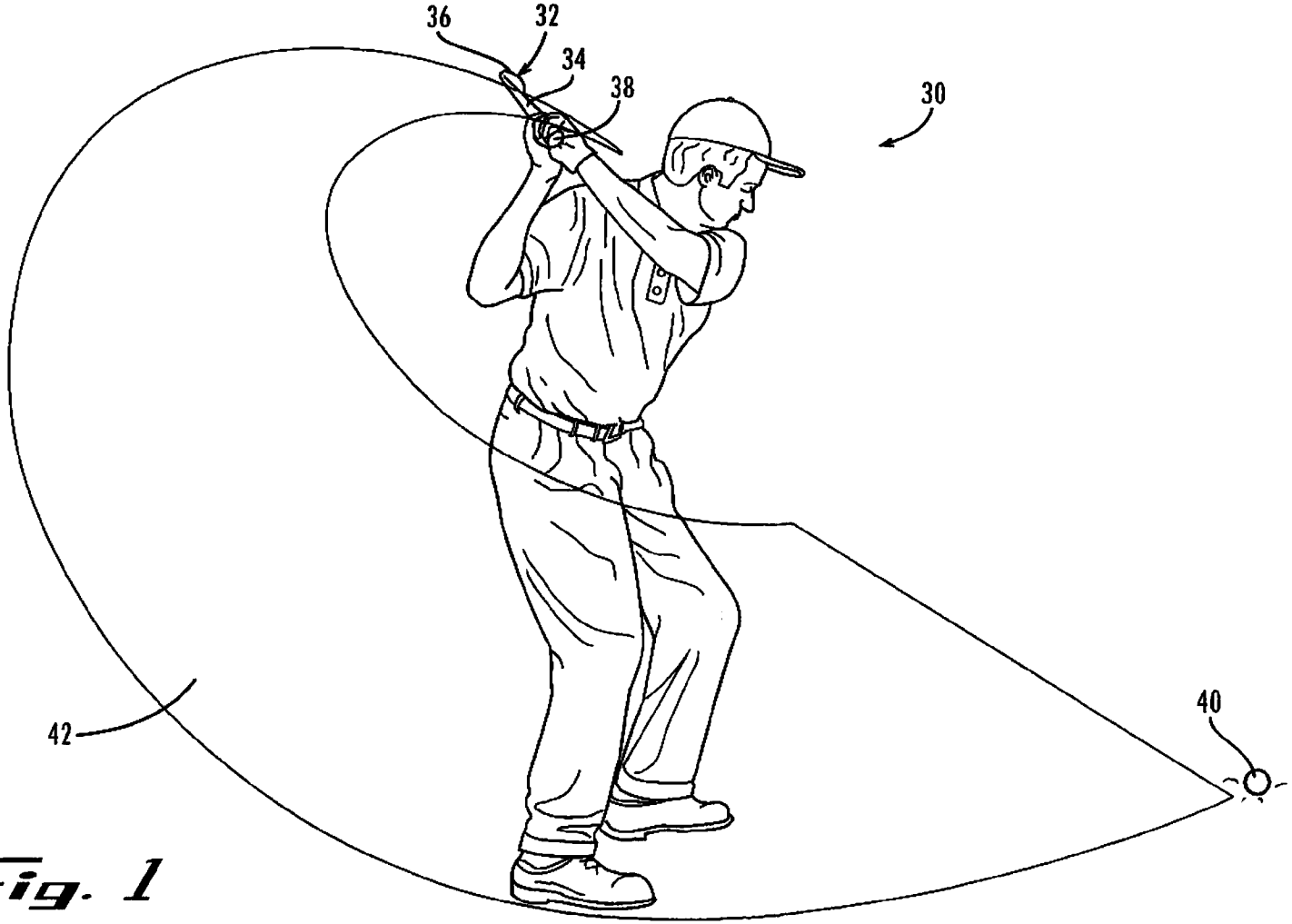
FIG. 1 is a perspective view showing a golfer having moved a golf club fully through a backswing to a backswing-completion position (hereinafter referred to as the three o'clock position by viewing the club as being the hand of a clock) and through a generally "C" shaped path, the plane of which is referred to as a club shaft plane, representing the ideal plane of travel of a shaft of the golf club during the backswing thereof.

Referring to FIG. 1, a golfer 30 has completed a backswing of a golf club 32, with the club being at the peak of the backswing, or backswing-completion position, and poised for the beginning of a downswing of the club, in anticipation of the completion of a full stroke. The club 32 includes a club shaft 34 extending between a distal end and a proximal end thereof. A club head 36 is mounted on the distal end of the shaft 34, and a grip 38 is formed about a portion of the shaft at or near the proximal end of the shaft.

The grip 38 typically extends from its outboard end disposed at the proximal end of the shaft 34 towards the distal end of the shaft, and terminates at an inboard end of the grip along an intermediate portion of the shaft. In preparation for swinging the club 32, the golfer 30 positions the golfer's hands on the grip 38 in a conventional club-gripping manner, whereby the thumb of one hand, for example, the right hand, is closer to the inboard end of the grip 38 than the thumb of the other hand. For description purposes, the thumb which is closer to the inboard end of the grip 38 is referred to herein as the inboard thumb.

Prior to initiating the backswing, the golfer 30 has placed the golfer's hands around the grip 38 in the conventional golf-gripping manner, and has addressed a golf ball 40, which is located in front of the golfer at an address, or six o'clock, position (FIG. 6), ideally to align the sweet spot of the club head 36 with the ball.

During the backswing movement of the club 32 from the six o'clock position to the backswing-completion position illustrated in FIG. 1, the golfer 30 moves the club shaft 34 through a generally "C" shaped path 42, referred to hereinafter as the club shaft plane. The ideal club shaft plane flattens and skews slightly during the downswing to create a separate and distinct ideal downswing club shaft plane. The golfer's ability to generate an ideal downswing club shaft plane is dependent on the golfer's ability to maintain an ideal backswing club shaft plane. By maintaining the club within these ideal club shaft planes, the golfer is more likely to strike the golf ball 40 with the sweet spot of the club face 52 to attain the desired trajectory and direction of the ball.

While professional golfers occasionally make errant shots, such shots are infrequent. With their inherent ability, training regimen, muscle balance and muscle memory patterns, the professionals consistently make shots which attain the desired trajectory and direction of travel of the ball 40. However, most other golfers continuously wrestle with the nagging problem of being unable to swing the golf club 32 in such a manner to bring about the lofty goal of consistent and desired ball trajectory and direction. While it is unlikely that most non-professional golfers will ever attain the inherent ability demonstrated by professional golfers, the non-professional golfers can improve their playability of the game of golf through the training of selected muscles used in the swinging of a golf club.

As a starting point, in order to attain the desired result, the golfer 30 must possess the ability to properly grip the club 32, and to maintain an appropriate stance and posture when swinging the club. Then, the golfer 30 must commit to exercising certain muscle groups, which are located in their hands, wrists, shoulders and other parts of the body, necessary to provide the consistent ability to produce good golf shots under any kind of pressure.

Various embodiments of muscle trainers described herein are designed to facilitate methods of exercising and training the appropriate muscles typically utilized by the golfer 30 in the swinging of the club 32. Such exercises are designed to enhance the strength and balance of these muscles, and to fine tune the muscle memory patterns necessary for consistent production of good golf shots. The methods of exercising accomplished by the use of the muscle trainers described herein can be appreciated by an understanding of the below-described principles of the relationships between the swinging of the golf club 32 and the muscles and muscle groups involved in such swinging action.

In the two-plane-merger golf swing theory, the two planes are referred to as the club shaft plane 42 and the club face plane. With regard to the club shaft plane, it would be very difficult, if not impossible, for a human being to swing the golf club 32 through a complete stroke while keeping the club shaft 34 in one club shaft plane which is a true plane. Hence, it is correct to state that the path in which the club shaft travels is not typically a true plane. The club shaft plane 42 can be thought of as a composite of an infinite number of planes existing in a tangential relationship to the path of the club shaft 34.

The club face plane represents the position of the club face 52, in space, during the swing. Regardless of the loft of the club face, the club face plane represents the position of the club face as if the club face had zero degrees of loft, and is more appropriately defined as a true plane since it is an extension of the surface of the zero degree club face. The concept of the club face plane helps one to visualize the relationship between the movement of the club face 52 and the club shaft 34 during the swinging motion of the club.

At the address, or six o'clock, position (FIG. 6), the club face plane is ideally a vertical plane which is essentially perpendicular to the club shaft plane. During the backswing (FIG. 1), the club face 52 and the club face plane are rotated, by the golfer, about the axis of the club shaft 34 to allow for a mechanically efficient movement in which the club face plane slices through the air in an aerodynamic fashion. Ideally, for a right handed golfer in the first half of his backswing, the club face plane is rotated approximately ninety degrees in a counter-clockwise direction such that, somewhere between the 8:00 and 10:00 positions, the club face plane merges, and is co-planar, with the club shaft plane 42. This ideal ninety degree rotation creates what is referred to as the merged position. At the backswing completion position and during the downswing, the club face plane should remain merged with the club shaft plane until just before impact when the club face plane is rotated approximately ninety degrees into an impact position, which is once again perpendicular to the club shaft plane. The relationship of the club face plane and the club shaft plane during the follow-through should approximate the mirror image of the relationship of the two planes during the backswing with a remerger of the two planes occurring between the four o'clock and six o'clock positions. This action defines the two-plane-merger golf swing theory. Such two-plane-merger is essential in developing a repeatable swing pattern which is effective under pressure.

Figure 3:
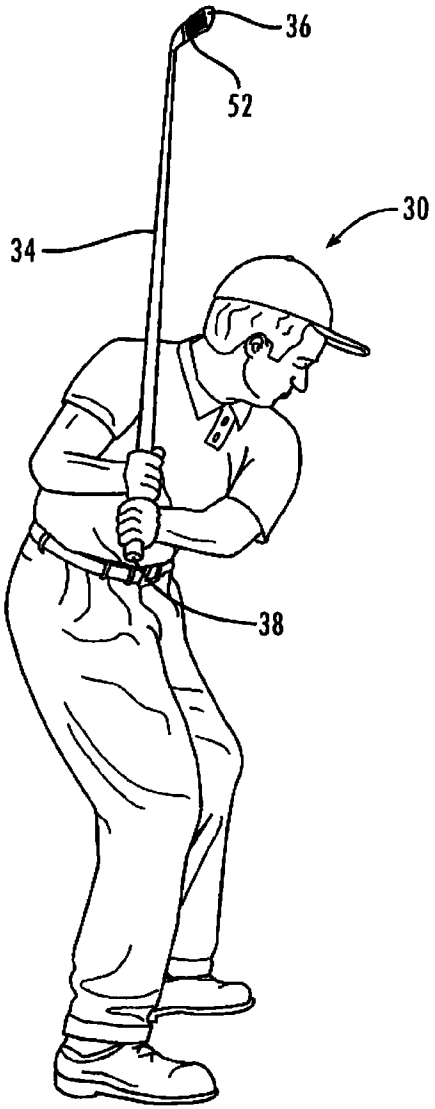
FIG. 3 is a perspective view showing the golfer of FIG. 1 with the club having nearly reached the backswing completion position and being located undesirably in front of the ideal club shaft plane of FIG. 1.
Figure 2:
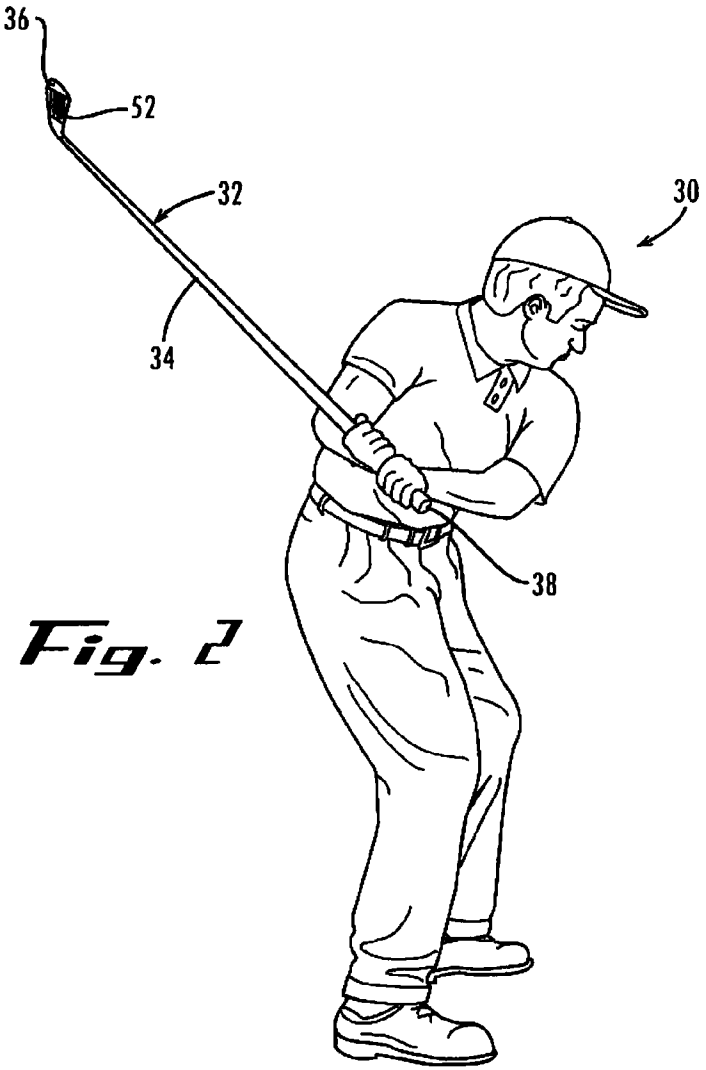
FIG. 2 is a perspective view showing the golfer of FIG. 1 with the club having nearly reached the backswing completion position, and being located undesirably behind the ideal club shaft plane of FIG. 1.

With respect to the club shaft plane 42 shown in FIG. 1, it is not uncommon for the non-professional golfer 30 to position the club shaft 32 outside of the ideal club shaft plane. Such deviation from the ideal club shaft plane is referred to herein as positioning the club shaft in front of or behind (i.e., above or below, respectively, as viewed in FIG. 1) the ideal club shaft plane. Referring to FIG. 2, the illustrated location of the club 32 indicates that the club shaft 34 is in a position which is behind the ideal club shaft plane 42 illustrated in FIG. 1. Referring to FIG. 3, the illustrated location of the club 32 indicates that the club shaft 34 is in a position which is in front of the ideal club shaft plane 42 illustrated in FIG. 1.

It is important for the golfer to minimize, and hopefully eliminate, the amount of club shaft deviation, which is behind, or in front of, the ideal club shaft plane. This requires a proper and balanced functioning of a group of opposing muscles in the golfer's hands and forearms. This muscle group is referred to as the club shaft plane opposing muscle group. The two sets of opposing muscles within the club shaft plane group are the behind-the-plane muscles and the front-of-the-plane muscles. The behind-the-plane muscles are responsible for positioning the club shaft 34 behind the ideal club shaft plane 42 and the front-of-the-plane muscles are responsible for positioning the club shaft 34 in front of the ideal club shaft plane 42. When these two sets of opposing muscles are acting in concert, where the sets are of equal strength and balance, the golfer 30 is able to swing the golf club 32 with the club shaft 34 in the ideal club shaft plane 42.

The direction of any deviation of the club shaft 34 during the swing, whether such direction is behind or in front of the ideal club shaft plane 42, can be determined by an observer of the golfer during the swing and presented to the golfer for use in taking corrective action such as that described herein. Also, a video camera can be used to record the golfer's direction of deviation, and thereafter observed by the golfer 30 in a video playback for use in taking corrective action.

Figure 6:
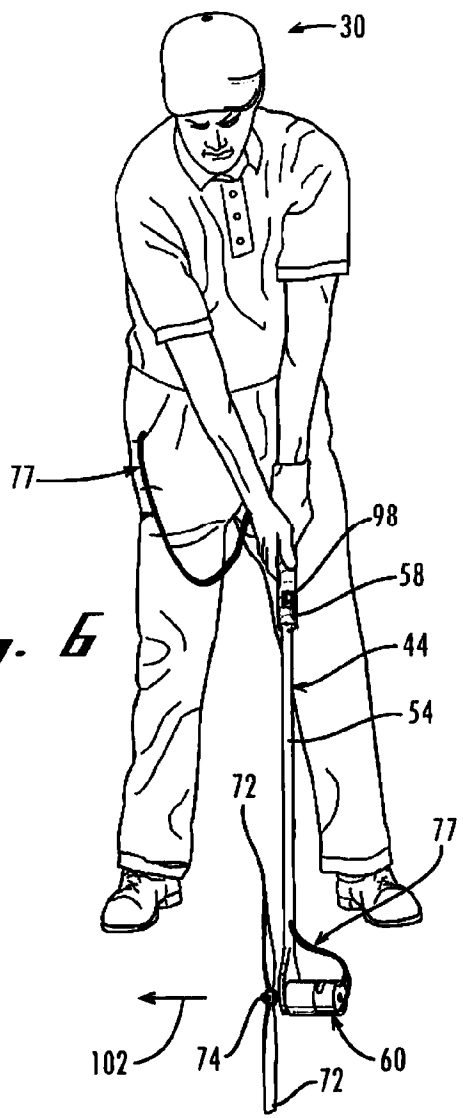
FIG. 6 is a front perspective view showing the golfer of FIG. 1 gripping the muscle trainer of FIG. 4, with the muscle trainer in a six o'clock position in preparation for a muscle training exercise, in accordance with a preferred embodiment of the invention.

When the golfer 30 is standing in the address position, as illustrated in FIG. 6, the hands, wrists, arms and shoulders of the golfer form a triangle. For a right-handed golfer, the front-of-the-plane muscles are located on the back of the left hand, the outside of the left forearm, the palm of the right hand and the inside of the right forearm. The behind-the-plane muscles are the mirror image of the front-of-the-plane muscles. For a left-handed golfer, these relationships are exactly opposite.

During the swing, the front-of-the-plane muscles and the behind-the-plane muscles are, in essence, in a tug-of-war, with the two sets of muscles being at opposite ends of an imaginary rope. If the behind-the-plane muscles are overacting, or dominating, the pulling force of these muscles moves the club shaft 34 behind the ideal club shaft plane 42. The opposite effect occurs if the front-of-the-plane muscles are overacting, or dominating. In such situations, a strengthening of the dominated muscle set is required in order to preclude either set from dominating the other set, thereby bringing balance to the tug-of-war and maintaining the club shaft 34 in the ideal club shaft plane 42.

The tug-of-war between these two sets of opposing club shaft plane muscles is further complicated by the need for an approximately ninety degree rotation of the club shaft 34 and club face 52 to merge the club face plane with the club shaft plane 42 as described above in the two-plane-merger golf swing theory. Errors within this two-plane-merger theory are referred to as demerged situations. These demerger errors occur when the amount of club face plane rotation is either greater or less than ninety degrees. When the angle of club face plane rotation is less than ninety degrees, the club face 52 is said to be in a closed or shut position. When the angle of club face plane rotation is greater than ninety degrees, the club face 52 is said to be in an open position.

Figure 7:
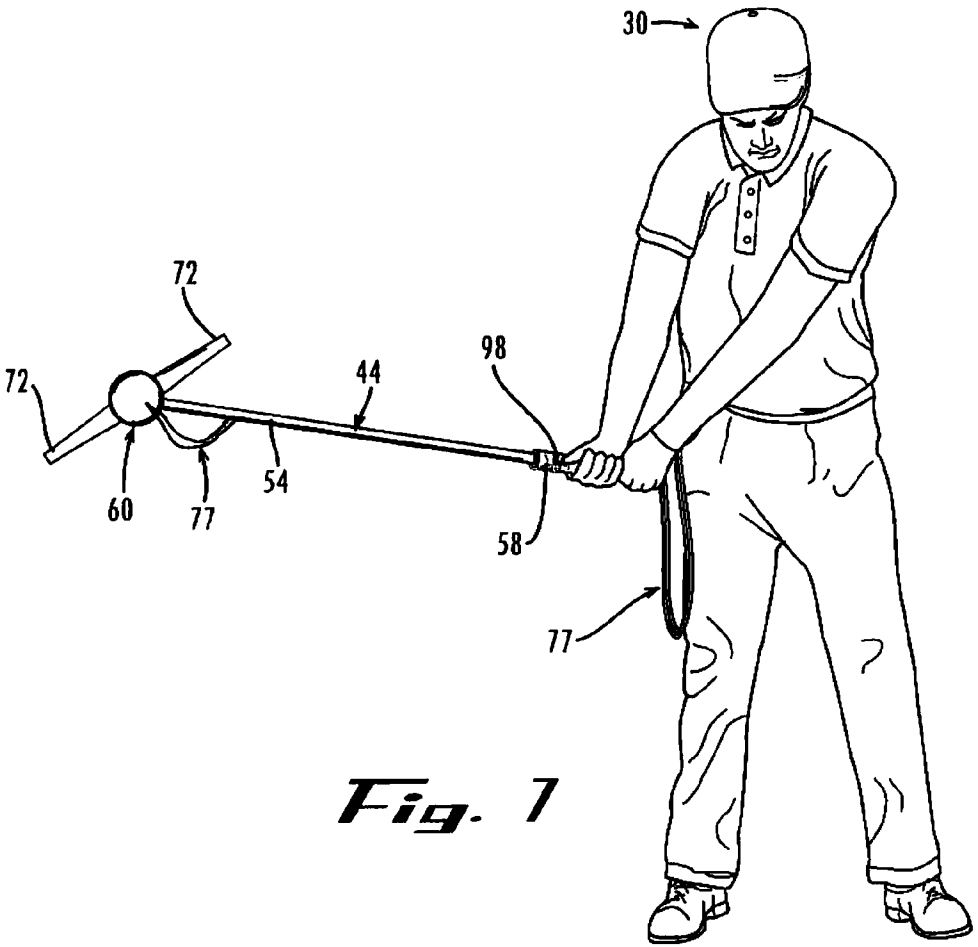
FIG. 7 is a front perspective view showing the golfer of FIG. 1 in a nine o'clock position, relative to the six o'clock position of FIG. 6, while gripping the muscle trainer of FIG. 4 in the process of a muscle training exercise, in accordance with a preferred embodiment of the invention.

The rotation of the club shaft 34 and the club face 52 to bring about two-plane-merger utilizes a group of opposing muscles known as the rotational opposing muscle group. When viewing a golfer's swing while standing in front of the golfer (FIGS. 6 and 7), the rotational muscle group can be divided into two sets of opposing muscles: the counter-clockwise rotational muscles and the clockwise rotational muscles.

In the two-plane-merger theory, over action of either set of opposing rotational muscles will result in the demerger errors described above. For example, during the backswing of a right-handed golfer, over action of the clockwise rotational muscles will result in closed club face position. Over action of the counter-clockwise rotational muscles will result in an open club face position.

A third group of opposing muscles in the arms and hands controls the hinging movement of the club 32 during the swing. This group of opposing muscles is referred to as the hinge opposing muscle group and is composed of two sets of opposing muscles, the hinge loading muscles and the hinge releasing muscles.

In a face-to-face perspective with a right handed or left handed golfer (FIG. 22A), the hinge opposing muscle group can be isolated by elevating and lowering the distal end of the muscle trainer within the vertical club face plane at the six o'clock address position. While keeping the arms and the rest of the body in a relatively fixed position, maximal elevation of the distal end of the muscle trainer without rotation of the club face plane demonstrates maximum and isolated function of the hinge loading muscles. Returning the maximally elevated distal end of the muscle trainer to the six o'clock address position without rotation of the club face plane, similarly demonstrates maximum and isolated function of the hinge releasing muscles.

Figure 22A:
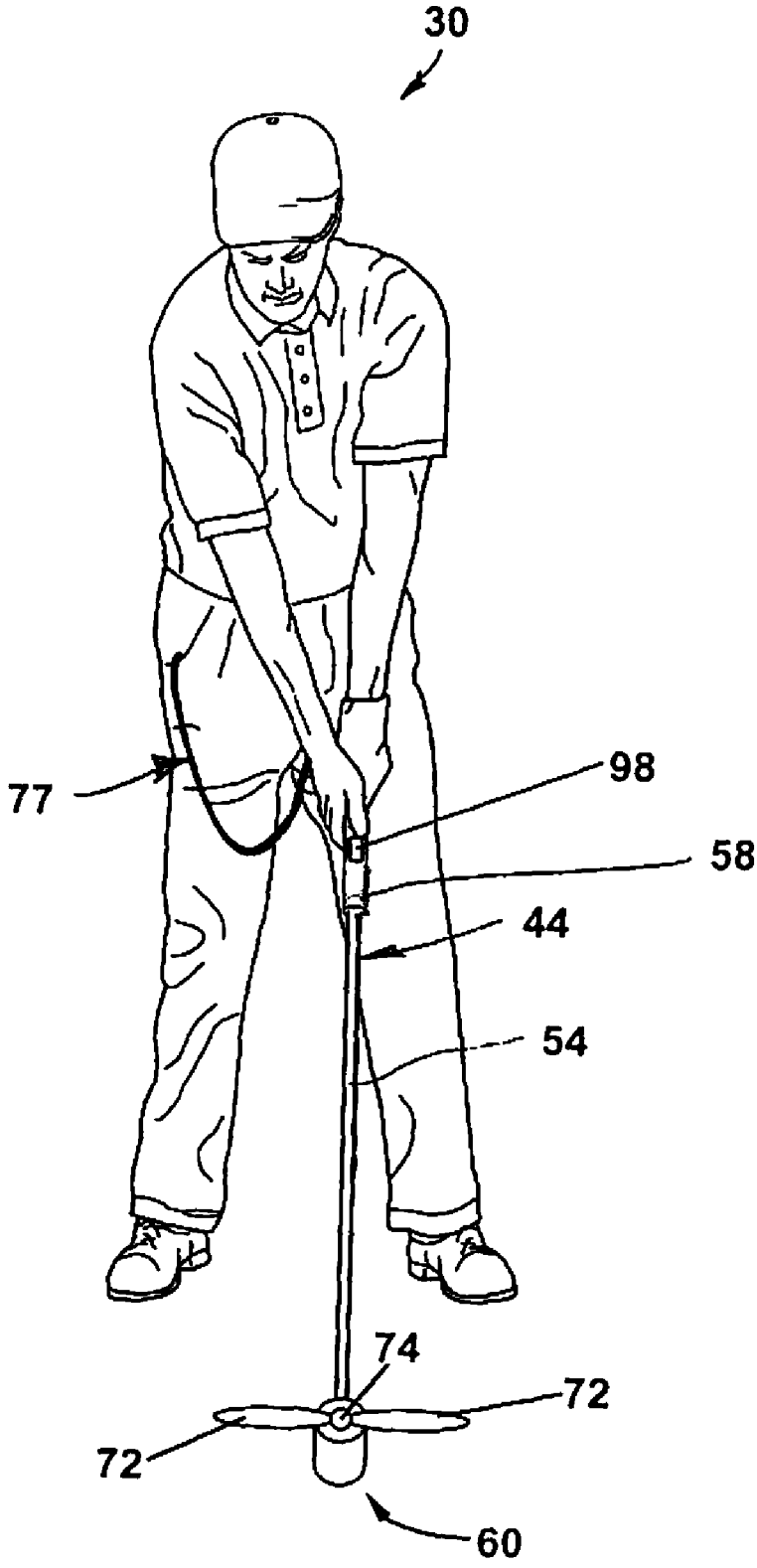
FIG. 22A is a front perspective view showing the golfer of FIG. 1 gripping the muscle trainer of FIG. 4, with the muscle trainer in a six o'clock position and oriented to exercise hinge muscles in accordance with a preferred embodiment of the invention.
Figure 22B:
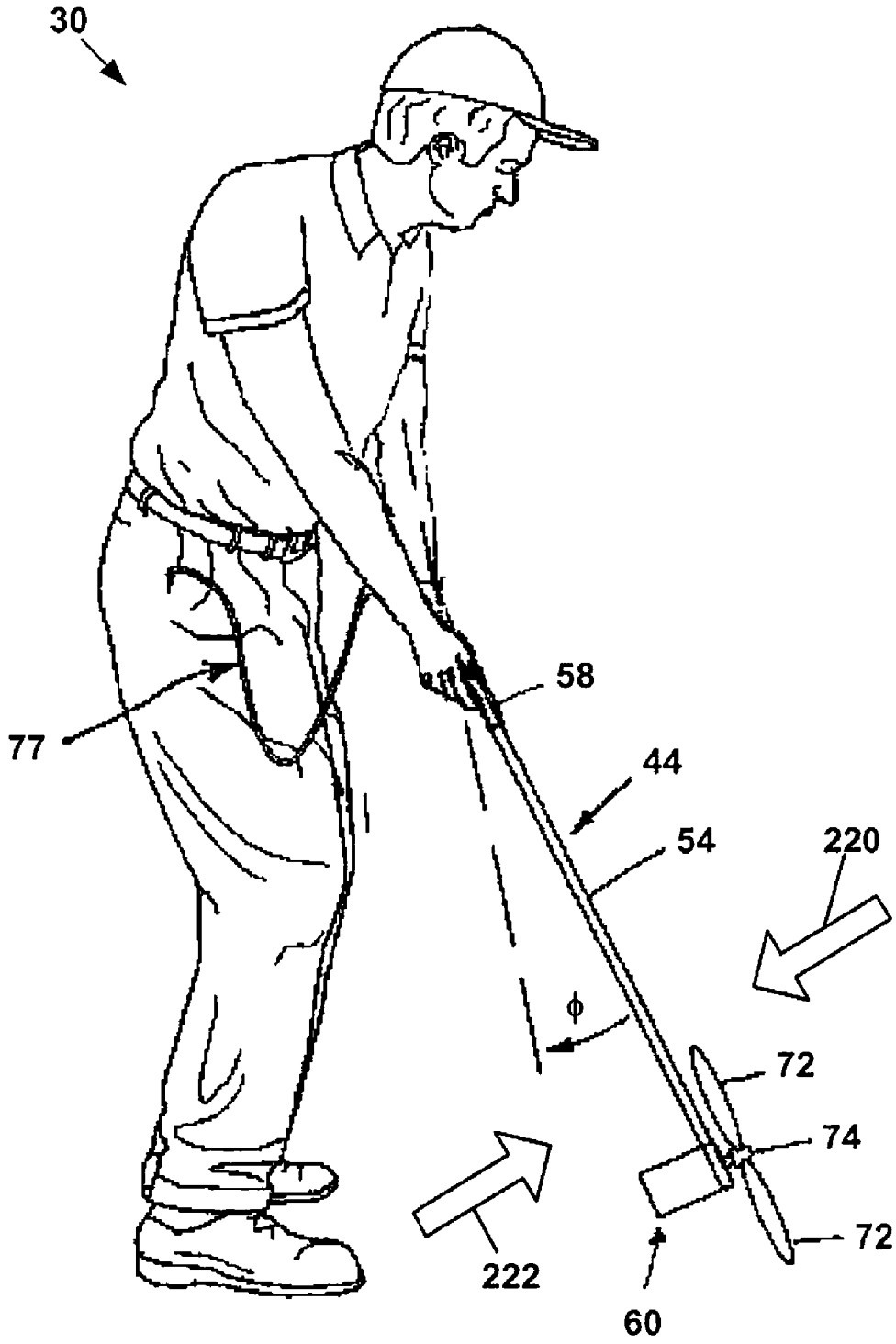
FIG. 22B is a side perspective view showing the right side of the golfer of FIG. 1 gripping the muscle trainer of FIG. 4, with the muscle trainer in a six o'clock position and oriented to exercise hinge muscles in accordance with a preferred embodiment of the invention.

As shown in FIG. 22B, for a right handed golfer, the hinge angle is the angle $\phi$ between the shaft 54 and the hatched line extending in a substantially coaxial fashion from the distal aspect of the left forearm. For a left handed golfer, the hinge angle is the angle $\phi$ between the shaft 54 and a similar imaginary line which is coaxial with the long axis of the right forearm and which extends from the distal aspect of the right forearm. Professional golfers will intentionally vary their hinge angle depending on the type of shot they are playing. Given that professional golfers will frequently flatten their downswing club shaft plane in relation to their backswing club shaft plane, it is incorrect to assume that the address hinge angle will be identical to the impact hinge angle.

To illustrate hinge errors, the intentional change in the hinge angle $\phi$ during the backswing will be set at ninety degrees. An under loaded hinge error occurs during the backswing when the change in the hinge angle $\phi$ is less than ninety degrees. An over loaded hinge error occurs during the backswing when the change in hinge angle $\phi$ is greater than ninety degrees.

An early release of the hinge angle error during the downswing occurs when the golfer allows the hinge angle $\phi$ to begin decreasing before the club shaft 34 approaches a horizontal position relative to the ground. This is one of the most common errors in golf and is referred to as casting. A late release of the hinge angle error during the downswing occurs when the golfer does not allow the hinge angle $\phi$ to begin decreasing at the appropriate hinge release point. This is a very uncommon error.

An under released hinge angle error occurs during the downswing when the golfer does not allow the hinge angle $\phi$ to decrease to the ideal impact hinge angle. This error plays a role in hitting thin shots and topped shots. A thin shot occurs when ball 40 is struck at a place below the sweet spot. The sweet spot is the ideal point of impact on the club face 52. A topped shot occurs when the lower edge of the club face strikes the ball above its equator, resulting in a downward trajectory of the ball into the ground. An over released hinge angle error occurs during the downswing when the golfer allows the hinge angle $\phi$ to decrease beyond the ideal impact hinge angle. This error plays a role in hitting fat shots. A fat shot occurs when the lower edge of the club face strikes the ground before the club face contacts the ball.

Other crucial variables associated with the swing include arc and speed. The arc refers to the path of the club head 36 and is determined by the amount of extension of the hands away from the golfer's body, the timing of the golfer's wrist hinge, the amount of shoulder turn, and the amount of hip turn by the golfer. The speed of the backswing is typically slower than the speed of the downswing. Variation in the speed of the swing and the timing of the transition between the backswing and downswing create the tempo of the swing. The arc and speed variables are much easier to manipulate and manage once the golfer has acquired the proper muscle memory for their ideal club shaft plane, ideal two-plane merger, and ideal hinging.

While practicing, a golfer may frequently use positioning drills to improve the positioning of the club during his swinging motion. These positioning drills are usually performed at a swing speed which is much slower than the swing speed the golfer uses in actual competition. Even with imbalanced muscle groups, reasonable attempts can be made to keep the club shaft within the ideal club shaft plane and to accomplish two-plane merger during periods when the club is being swung slowly. However, it becomes increasingly difficult to accomplish these goals when the speed of the swing is increased while striking the ball during a competitive round of golf. To maintain the ideal club shaft plane, two-plane-merger, and proper hinging when swinging at a speed the golfer uses during actual competition, there must be an exquisite balance between the opposing sets of muscles in the club shaft plane muscle group, rotational muscle group, and the hinge muscle group.

Thus, in order for any golfer suffering from the muscle domination deficiencies described above to improve their ability to play the game of golf, an exercise program to balance the three opposing muscle groups is an absolute necessity. Given that a golfer wishes to embark on such an exercise program, the key is to be able to address the specific needs of the muscles of the three groups in such a way that the ideal swing movements and the resultant ideal ball flight patterns are attainable.

The various muscle trainers described herein are designed to exercise the muscles of the three muscle groups, while placing a greater effort in strengthening the dominated, or weaker, sets of opposing muscles. In this manner, the dominating sets of muscles are exercised to retain the muscle tone thereof, while at the same time the dominated sets of muscles are worked and exercised more vigorously to improve the muscle tone thereof, and to bring the three muscle groups into a balanced condition. Further, by working and exercising the three muscle groups together, enhanced muscle memory patterns are developed there between.

Once the three muscle groups have attained parity in strength, balance, and memory patterns, the golfer 30 can maintain the club shaft 34 more consistently within the ideal club shaft plane 42, more effectively practice the principle of the two-plane-merger theory, and perform proper hinging action to attain desired trajectory, direction, and distance of travel of the ball 40.

Figure 4:
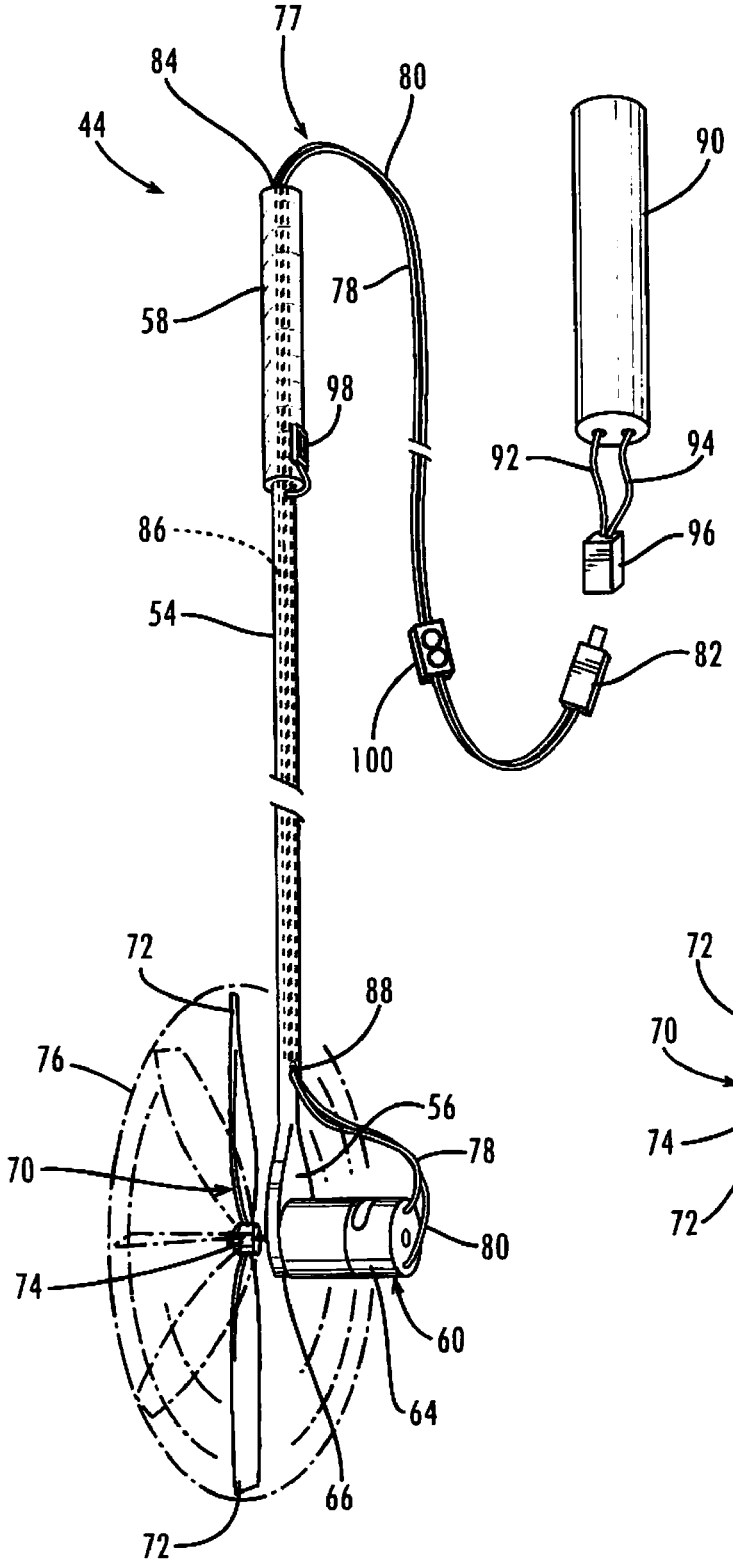
FIG. 4 is a perspective view of a muscle trainer in accordance with a first embodiment of the invention.
Figure 5:
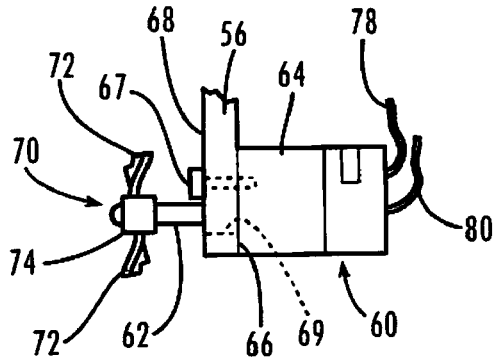
FIG. 5 is a partial side view showing a motor and fan blade assembly of the muscle trainer of FIG. 4 in accordance with a preferred embodiment of the invention.

As shown in FIGS. 4 and 5, the muscle trainer 44 of a first embodiment of the invention includes a hollow shaft 54 having a flat motor-mount pad 56 formed at a distal end of the shaft, and a grip 58 attached to an outer side of the shaft adjacent a proximal end thereof. The grip 58 is formed from a soft non-metallic material, such as, for example, leather, of the type typically used to form the grip of a conventional golf club, such as, for example, the club 32 (FIG. 1).

Referring to FIGS. 4 and 5, the muscle trainer 44 further includes an electric motor 60 having a rotatable drive shaft 62 extending from one end of a motor housing 64. One end of the motor housing 64 is placed against a first side 66 of the pad 56, and is attached to the pad, such as by screws 67. The drive shaft 62 extends through an opening 69 formed through the pad 56 to a second side 68 of the pad.

The motor 60 could be of the type typically used to power radio-controlled miniature models such as, for example, model airplanes. The motor 60 could be of the type referred to as universal motors, which can operate either from a DC power source or an AC power source, and which are commonly used to operate small household appliances and light-duty power tools. The speed of operation of the motor 60 can be controlled and varied, for example, by use of a rheostat, a variable transformer with rectification, or electronically by use of a silicon controlled rectifier. Further, a reversing switch can be used with the motor 60 to facilitate selective operation of the motor in either rotational direction. Suitable examples of speed controls and a reversing switch are described in Chapter 3, and illustrated at FIGS. 3.1.1, 3.1.2, 3.1.3 and 3.3.10, of a handbook titled "DC MOTORS SPEED CONTROLS SERVO SYSTEMS," Fifth Edition, August, 1980, obtained from Electro-Craft Corporation of Hopkins, Minn., and locatable by Library of Congress Catalog Card Number 78-61244.

Referring to FIGS. 4 and 5, a fan blade assembly 70 includes a pair of blades 72, which are fixedly attached to a hub 74. The hub 74 is mounted to the distal end of the rotatable drive shaft 62 of the motor 60, and is attached to the drive shaft 62 for rotation therewith. A protective cage 76 is preferably fixedly attached to the pad 56 to preclude the blades 72 from coming into injurious or damaging contact with anyone, or any object, external to the cage. It is noted that each of the embodiments of the muscle trainer described herein preferably include a protective cage, such as the cage 76, which is not illustrated in all of the drawings thereof for the purpose of providing a clear illustration of the environment of a fan blade assembly of each respective embodiment.

In the motor-mounted arrangement illustrated in FIGS. 4 and 5, a common axis of the motor 60 and the blades 72 preferably extends at an angle of about ninety degrees from the shaft 54. The combination of motor 60 and the fan blade assembly 70 are one embodiment of a force generator.

Referring to FIG. 4, a wiring assembly 77 includes a pair of electrically conductive wires 78 and 80, which are connected at one end thereof to a plug 82, and at an opposite end thereof to the motor 60. The wires 78 and 80 extend from the plug 82, through an axial opening 84 formed in the proximal end of the hollow shaft 54, through an axial passage 86 within the hollow shaft, through an opening 88 formed through a side portion of the shaft near the pad 56, and to the connection with the motor 60.

A power source 90, such as an interchangeable and rechargeable electrical battery pack, is preferably connected through a pair of electrical wires 92 and 94 to a receptacle 96, which mates with and is connectable to the plug 82, to facilitate the application of electrical operating power from the battery pack to the motor 60. An ample length of the wiring assembly 77 preferably extends between the plug 82 and the shaft opening 84 to provide for selective placement of the battery pack 90 by the golfer 30 during use of the muscle trainer 44. As indicated above, the motor 60 could be operated by use of an AC power source, such as a single-phase 60-hertz source typically available through a conventional household power outlet or the like. Alternatively, power cells, such as batteries, can be disposed in the handle or shaft of the club.

A spring-biased push-button switch 98 is mounted on the grip 58, at any location which provides convenient access to the thumbs, fingers or hands of the golfer 30 to facilitate selective operational control of the muscle trainer 44 by the golfer during an exercise session. Preferably, the push-button switch 98 is located on the grip 58 so that the inboard thumb of the golfer 30 overlays the switch 98 when the golfer places the golfer's hands around the grip 58 in the conventional club-gripping manner. While the golfer's hands are in this position, the golfer can selectively operate the motor 60 by depressing the push-button switch 98 when the golfer is in an exercise mode without disturbing the position of either hand around the grip 58.

During the period when the golfer 30 is processing through an exercise cycle, the golfer maintains the push-button switch 98 in the closed state by continuing to depress the switch 98, so that the motor 60 remains operational during the exercise cycle. Upon release of the push-button switch 98, the spring-biased switch is opened to remove operating power from the motor 60. If desired, the push-button switch 98 could be mounted at different locations on the grip 58 to accommodate different gripping positions of respective users of the muscle trainer 44.

Referring to FIG. 4, a control module 100 is connected to the wiring assembly 77 and contains a speed controller and a reversing switch, for example, such as that described above, to allow the user of the muscle trainer 44 to pre-select the speed and direction of rotation of the motor 60 prior to using the muscle trainer during an exercise mode. The speed controller is a first enhancement of the basic invention embodied in the muscle trainer 44, the reversing switch is a second enhancement of the basic invention embodied in the muscle trainer 44, and the combination of the speed controller and the reversing switch is a third enhancement of the basic invention embodied in the muscle trainer 44. In alternative embodiments of the invention, the control module 100 is located in the handle or elsewhere in the shaft.

Figure 23:
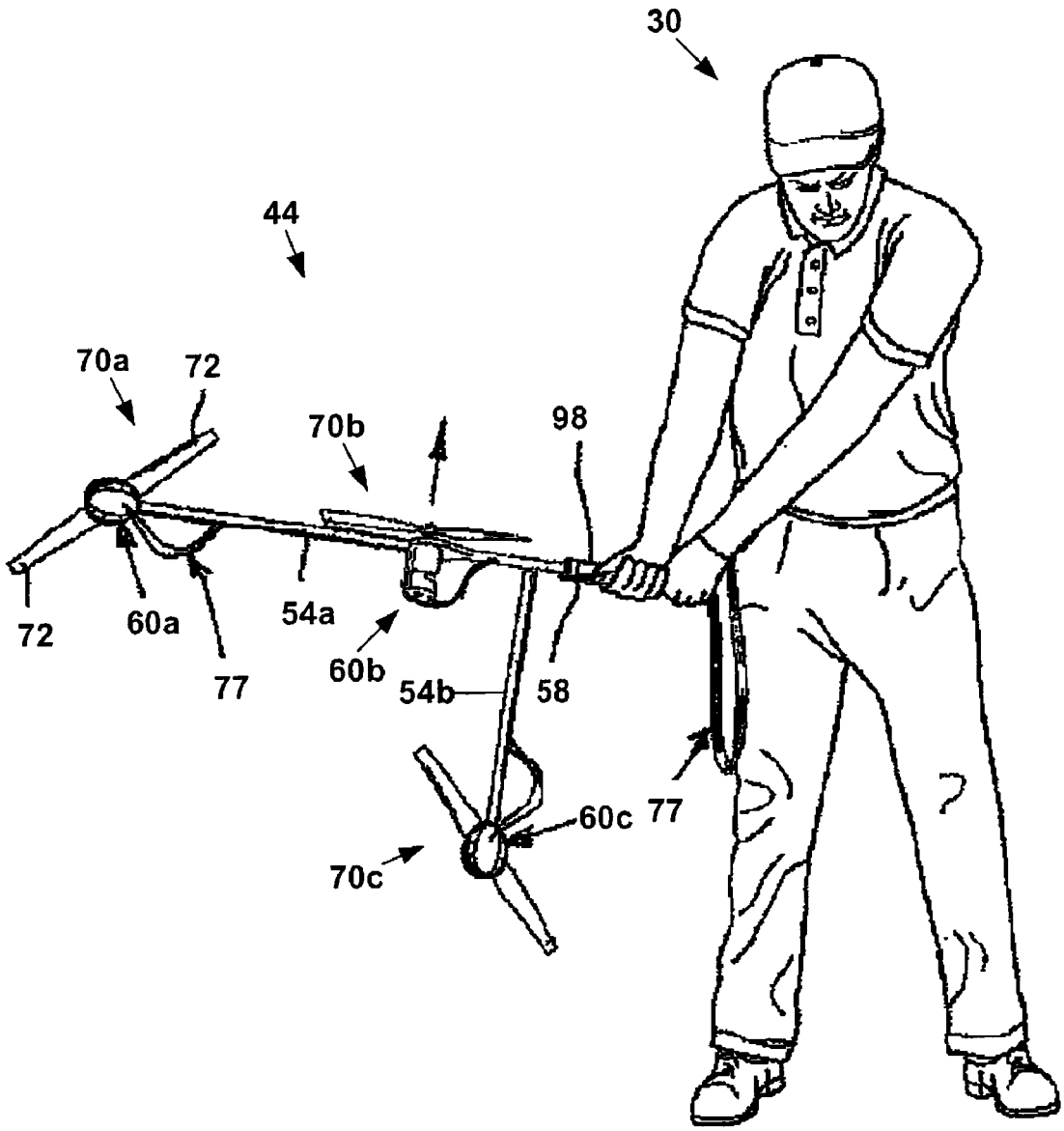
FIG. 23 depicts a front perspective view of a golfer gripping an embodiment of the muscle trainer having multiple force generators for generating forces in multiple directions.
Figure 24:
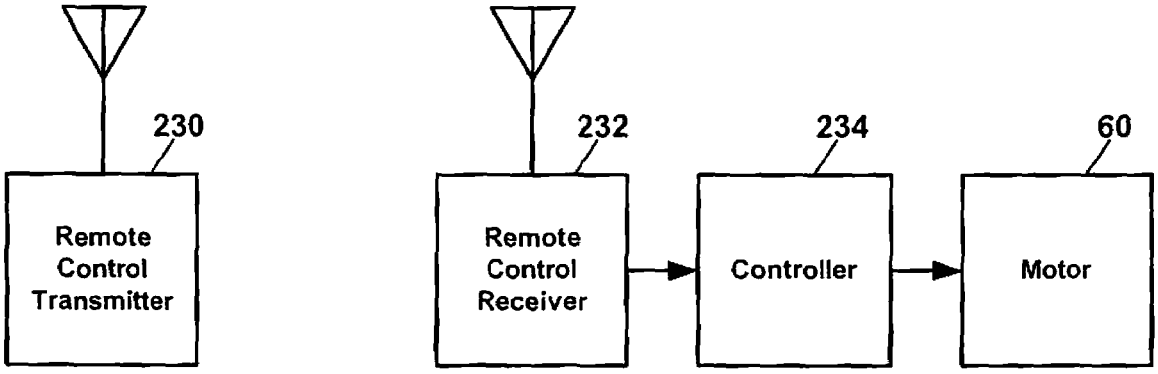
FIG. 24 depicts an embodiment of the muscle trainer that includes a remote control device for remotely controlling the activation, direction and speed of a force generator.

As shown in FIG. 24, an alternative embodiment of the invention includes a remote wireless control transmitter 230 which allows an observer, such as a teaching professional to facilitate selective operational control of the muscle trainer 44 while the golfer is swinging the muscle trainer 44. This embodiment includes a remote control receiver 232 for receiving wireless control signals transmitted from the transmitter 230. The receiver 232 is operatively connected to a controller circuit 234. The controller 234 controls the on/off state, speed and direction of the motor 60 based on the wireless control signals received by the receiver 232. The receiver 232 and the controller 234 may be disposed within the grip 58 or the shaft 54 of the muscle trainer 44. Alternatively, the receiver 232 and the controller 234 may be disposed within a separate housing connected to the muscle trainer via the wiring assembly 77. As one skilled in the art will appreciate, the remote control transmitter 230 and receiver 232 may operate according to digital or analog communication protocols using radio frequency (RF), infrared (IR) or other wireless communication means. It will be appreciated that the transmitter 230, receiver 232 and controller circuit 234 may be used to control one motor or multiple motors. A multiple-motor embodiment is depicted in FIG. 23 and is described in more detail hereinafter.

In another alternative embodiment, a remote wireless controller is operated in a real-time fashion by a computer and sensor system, such as described in of U.S. patent application Ser. No. 11/376,974, the entire contents of which are incorporated herein by reference. As the computer senses deviations from the ideal motion, it transmits commands to one or more force generators on the muscle trainer which activate the force generators to correct the deviation.

In the following example of use of the muscle trainer 44, and the practice of a method of exercising the club shaft plane opposing muscle group, the golfer 30 is a right-handed golfer, and the front-of-the-plane muscles are the set of dominated muscles.

When the golfer 30 anticipates using the muscle trainer 44 during an exercise session, the golfer will preferably use the conventional golf club 32 and process through several practice strokes in the presence of a personal observer, or in front of a video camera, in order to determine, as described above, whether the club shaft 34 is in front of the ideal club shaft plane 42 or behind the ideal club shaft plane. Assuming that information relayed by the observer, or through use of the video camera, indicates that the golfer's front-of-the-plane muscles are the dominated set of muscles, the golfer 30 will make the desired speed and direction-of-rotation adjustments, through the control module 100.

The speed of the motor 60 and the blades 72 will establish the magnitude of a pulling force at which the distal end of the muscle trainer 44 is urged in the manner described below. The golfer 30 can adjust the speed controller of the control module 100 to selectively establish the linear pulling force level at which the golfer wishes to conduct the exercise cycle. Then, as described below, the adjustment of the reversing switch of the control module 100 will establish the direction in which the linear pulling force is to be applied.

After making the speed and direction-of-rotation adjustments at the control module 100, the golfer 30 then places the battery pack 90 of the muscle trainer 44 in a convenient location such as, for example, the right front pocket of the golfer's pants as illustrated in FIG. 6. It is noted that, instead of placement in the pants pocket, the battery pack 90 could be clipped to the golfer's belt or placed at other locations which will accommodate a comfortable and unimpeded swinging of the muscle trainer 44.

The golfer 30 grasps the grip 58 of the muscle trainer 44 in the conventional club-gripping manner, with the blades 72 extending to the right of the golfer, again as indicated in FIG. 6. The golfer 30 assumes a position and stance as if the golfer is addressing a ball at the six o'clock position as illustrated in FIG. 6. It is noted that the combined axial length of the grip 58, the shaft 54, the pad 56 and the blades 72 is slightly less than the length of a typical golf club, such that the blades are above a surface on which the golfer is standing during the exercise session.

The golfer 30 depresses the spring-biased push-button switch 98, such as by use of the golfer's inboard thumb, to operate the motor 60. With the appropriate direction of rotation of the motor 60 having been selected by prior adjustment of the reversing switch, the linear pulling force generated by the rotary movement of the blades 72 will urge the distal end of the muscle trainer 44 to the golfer's right, as indicated by an arrow 102 in FIGS. 6, 8 and 9. To initiate an exercise phase of the exercise cycle, the golfer 30 swings the muscle trainer 44 from the address position (FIG. 6) through a conventional non-stop backswing while processing through the positions shown in FIGS. 7, 8 and 9.

In the alternative, the golfer 30 could process the muscle trainer 44 through several step-and-stall motions, as described below, until reaching the fully completed backswing position illustrated in FIG. 9. During the step-and-stall motions, the golfer steps the trainer from the address position at six o'clock to a next position, such as, for example, the seven o'clock position, and stalls the motion of the trainer before advancing, for example, to the eight o'clock position. This pattern is continued through each clock position, for example, and so on to the fully completed backswing position illustrated in FIG. 9, while retaining the muscle trainer at each stepped position for a prescribed time before moving the trainer to the next stepped position.

During the non-stop backswing or the step-and-stall motions by the golfer 30, the dominating set of behind-the-plane muscles and the dominated set of in-front-of-the-plane muscles, work together in the tug-of-war context in an attempt to maintain the shaft 54 of the muscle trainer 44 within the club shaft plane through the swinging stroke in the same manner that such sets of muscles would move the golf club 32 when the golfer is swinging the club. In this manner, the dominating set of muscles and the dominated set of muscles are being worked together to the extent that both sets are being exercised and the muscle memory patterns of the two sets are being enhanced.

Figure 9:
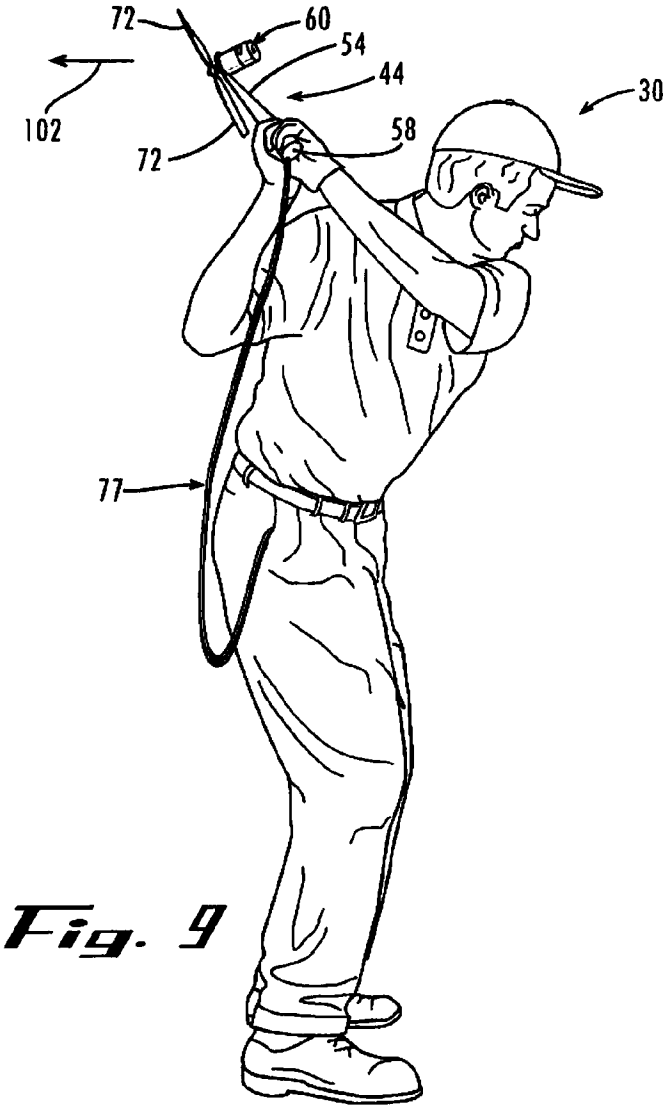
FIG. 9 is a side perspective view showing the right side of the golfer of FIG. 1 in the backswing-completion position of FIG. 1 while gripping the muscle trainer of FIG. 4 in the process of a muscle training exercise, in accordance with a preferred embodiment of the invention.
Figure 8:
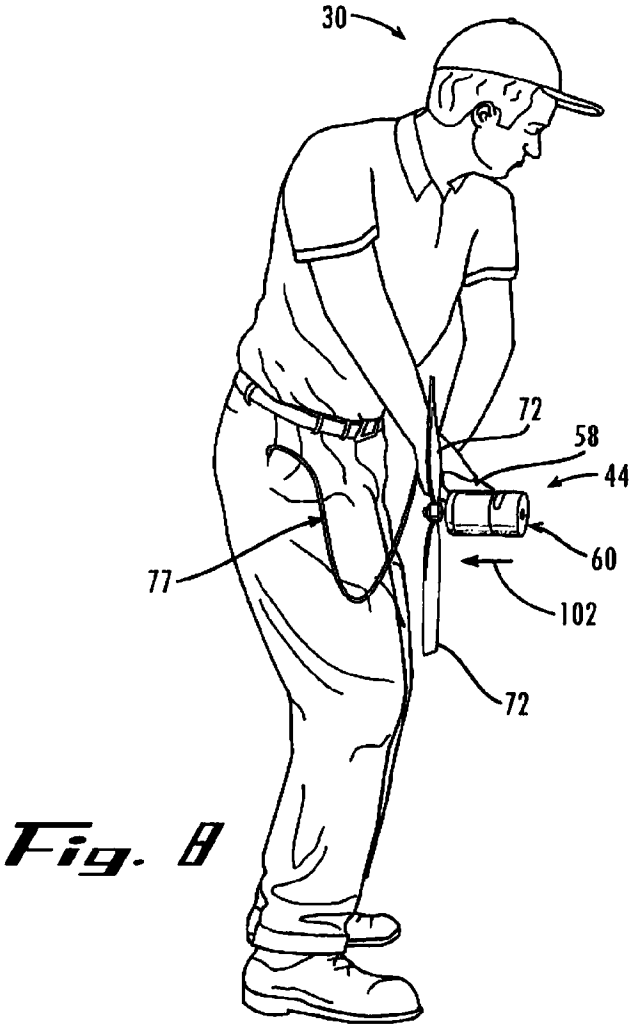
FIG. 8 is a side perspective view showing the right side of the golfer of FIG. 1 in the nine o'clock position of FIG. 7 while gripping the muscle trainer of FIG. 4 in the process of a muscle training exercise, in accordance with a preferred embodiment of the invention.

Additionally, as indicated by the arrow 102 in FIGS. 8 and 9, the motor 60 is rotating the blades 72 in such a direction that the linear pulling force generated by the rotating blades is urging, or attempting to pull, the muscle trainer 44 in the illustrated direction. This direction is opposite the direction that the dominated set of in-front-of-the-plane muscles would normally be directing the trainer 44. Consequently, the dominated set of muscles, which in this instance is the front-of-the-plane muscles, is working more strenuously than the dominating set of muscles, i.e., the behind-the-plane muscles, not only to attempt to locate the shaft 54 in the club shaft plane, but to also overcome the linear pulling force of the rotating blades 72. In this manner, the front-of-the-plane muscles, which comprise the dominated set of muscles, are being stressed more than the behind-the-plane muscles, in an exercise context.

Upon reaching the full backswing position (FIG. 9), the golfer 30 releases the spring-biased push-button switch 98, and the motor 60 ceases to operate, thereby completing one cycle of the exercise motion, with the resulting effect of overtraining the front-of-the-plane muscles to thereby bring the tug-of-war between the two sets of opposing muscles into a balanced perspective leading to the sculpting of an ideal club shaft plane.

If the front-of-the-plane muscles of a right handed golfer are the dominating muscles, the muscle trainer 44 may be revolved through one hundred and eighty degrees so that the linear pulling force of the rotating blades 72 is in a direction which is opposite the direction of the arrows 102, shown in FIGS. 6, 8, and 9. The muscle trainer 44 would then be processed through the same exercising steps described above, except that the behind-the-plane muscles, which in this instance are the dominated muscles, would be more strenuously exercised for the reasons expressed above.

In the alternative, the reversing switch of the control module 100 could be reversed from the state described above, where the front-of-the-plane muscles were the dominated muscles, so that the rotation of the motor 60, and the blades 72, would be reversed to provide a linear pulling force in a direction opposite the direction of the arrows 102 shown in FIGS. 6, 8, and 9.

If the golfer 30 is left handed, the orientations of the linear pulling forces for the left handed golfer are mirror images of the above described pulling forces for the right handed golfer. Therefore, the reversing switch of the muscle trainer 44 would be switched accordingly to provide the mirror image pulling forces to accommodate the left handed golfer 30. Otherwise, the muscle trainer 44 would be used in the same manner as described above with respect to the right handed golfer.

In a similar manner, the muscle trainer 44 can also be used to selectively train the hinge opposing muscle group. As shown in FIGS. 22A and 22B, to place the linear pulling force in the hinge plane, the golfer 30 grasps the grip 58 of muscle trainer 44 with the shaft 54 having been rotated ninety degrees in either a clockwise or a counter-clockwise direction from the shaft's orientation shown in FIGS. 6, 7, 8 and 9. As above, the golfer can proceed with a non-stop swing and depress the push-button switch in the section of the swing in which hinge training is needed, or use step-and-stall motions to accomplish the needed hinge training.

As stated above, the most common hinging error is known as casting. For a right-handed or left-handed golfer with over action of the hinge releasing muscles at the beginning of the downswing, the hinge angle $\phi$ would be inappropriately decreasing during this section of the swing. To achieve proper hinging in this situation, the dominated hinge loading muscles must be exercised in a more strenuous fashion than the dominating hinge releasing muscles. This would require that the propeller generate a linear pulling force on the implement which will urge the distal end of the muscle trainer 44 in the hinge release direction as indicated by the arrow 220 in FIG. 22B. Likewise, if there is over action of the hinge loading muscles at any point during the swing, the propeller would need to generate a linear pulling force on the implement which will urge the distal end of muscle trainer 44 in the hinge loading direction as indicated by the arrow 222 in FIG. 22B.

Figure 10:
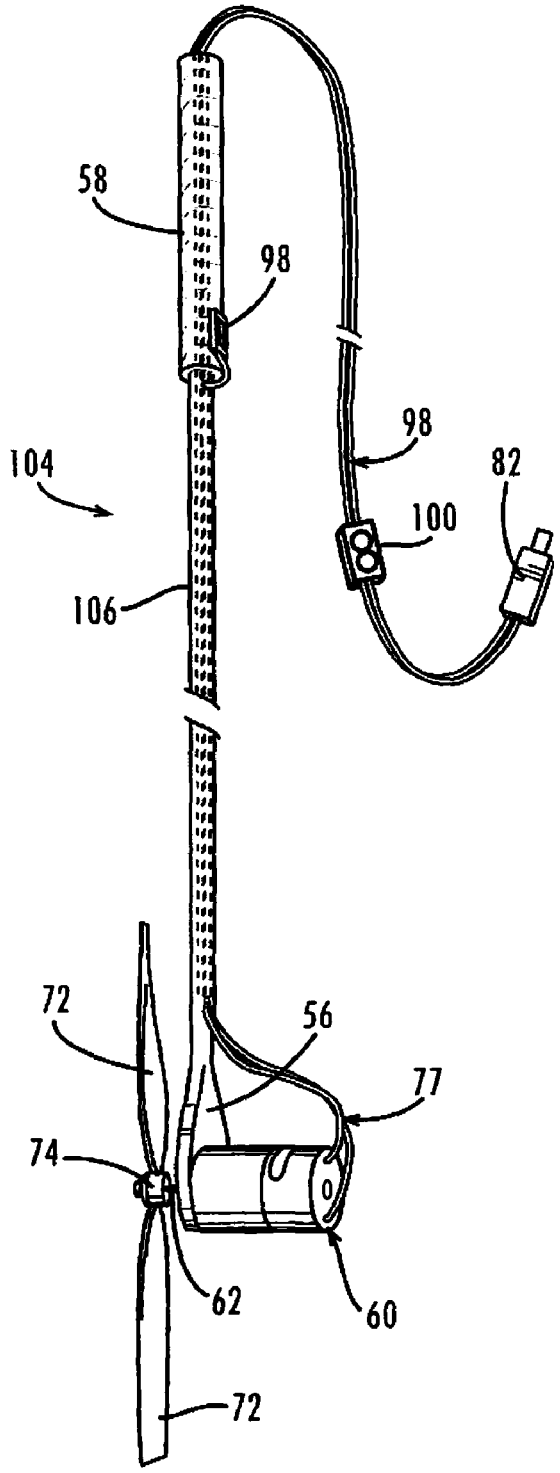
FIG. 10 is a perspective view showing a muscle trainer in accordance with a second embodiment of the invention.

As shown in FIG. 10, the muscle trainer 104, which is a second embodiment of the invention, includes a hollow shaft 106. The muscle trainer 104 differs from the muscle trainer 44 (FIG. 4) in that the length of the shaft 106 is shorter than the length of the shaft 54. Otherwise the muscle trainers 44 and 104 are substantially identical. Except for the shaft 106, the elements of the muscle trainer 104 are identified in FIG. 10 by the same numbers as the corresponding elements of the muscle trainer 44 shown in FIG. 4.

In the motor-mounted arrangement of the muscle trainer 104 illustrated in FIG. 10, a common axis of the motor 60 and the blades 72 extends at an angle of ninety degrees from the shaft 54 in the same manner as in the motor-mounted arrangement of the muscle trainer 44.

The muscle trainer 104 is preferably used in the same manner as the muscle trainer 44, as described above. The shorter shaft 106 allows the muscle trainer 104 to be used in a closer-quarters environment, such as, for example, a room within a house. Otherwise, the advantages attainable by use of the muscle trainer 44, as described above, are also attainable by use of the muscle trainer 104.

As noted above, the rotation of the club shaft and the club face to effect the two-plane merger utilizes a rotational opposing muscle group, which includes the counter-clockwise rotational muscles and the clockwise rotational muscles. These rotational muscles should also be exercised and sculpted to provide total enhancement of the golfer's swing.

Figure 12:
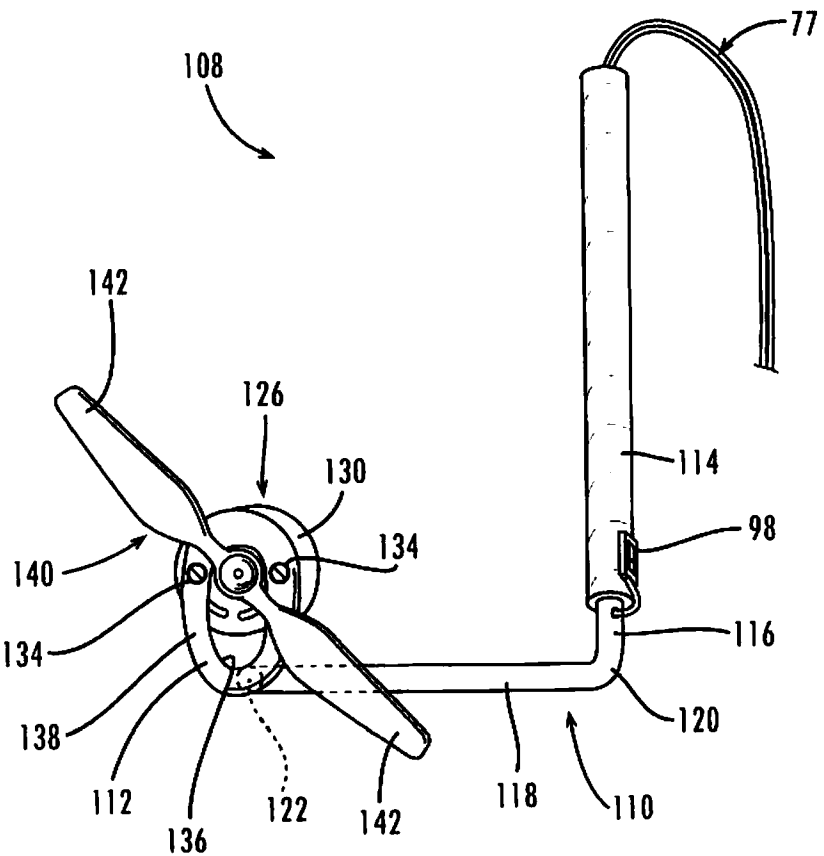
FIG. 12 is a front perspective view showing a muscle trainer in accordance with a third embodiment of the invention.

With that in mind, as shown in FIGS. 12 and 13, the muscle trainer 108 is a third embodiment of the invention. The muscle trainer 108 includes a hollow shaft 110 having a flat motor-mount pad 112 formed at a distal end of the shaft, and a grip 114 attached to an outer side of the shaft adjacent a proximal end thereof. The grip 114 is formed from a soft non-metallic material, such as, for example, leather, of the type typically used to form the grip of a conventional golf club, such as, for example, the club 32.

The shaft 110 is formed with a first straight section 116 which includes the grip 114, and a second straight section 118 which extends at an angle of substantially ninety degrees from the section 116 at a juncture 120 of the first and second straight sections. The shaft 110 is further formed with a third straight section 122, which extends at an angle of substantially ninety degrees from the second straight section 118 at a juncture 124 of the second and third straight sections. The first straight section 116 is also referred to herein as a grip section, the second straight section 118 is also referred to herein as an intermediate section, and the third straight section 122 is also referred to herein as a motor-mount section.

As shown in FIGS. 12 and 13, the first and second straight sections 116 and 118, respectively, of the shaft 110 are located in a plane, hereinafter referred to as "the common plane," while the third straight section 122 extends perpendicularly from the common plane.

Referring to FIGS. 12 and 13, the muscle trainer 108 further includes an electric motor 126 having a rotatable drive shaft 128 extending from one end of a motor housing 130. The one end of the motor housing 130 is placed against a first side 132 of the pad 112, and is attached to the pad by screws 134. The drive shaft 128 extends through an opening 136 formed through the pad 112, and from a second side 138 of the pad.

A fan blade assembly 140 includes a pair of blades 142, which are fixedly attached to a hub 144. The hub 144 is mounted on the free end of the rotatable drive shaft 128 of the motor 126, and is attached to the drive shaft for rotation therewith. In this arrangement, the combination of the motor 126 and the fan blade assembly 140 form a force generator.

A protective cage of the type shown in FIG. 4 may be fixedly attached to the pad 112 to preclude the blades 142 from coming into injurious or damaging contact with anyone or any object external to the cage. The muscle trainer 108 also preferably includes the wiring assembly 77, the battery pack 90, the push-button switch 98, and the control module 100 with the speed controller and the reversing switch in the same fashion as the muscle trainer 44.

In the motor-mounted arrangement of the muscle trainer 108, as illustrated in FIGS. 12 and 13, a common axis of the motor 126 and the blades 142 extends at an angle of ninety degrees from the common plane in which the first and second sections 116 and 118, respectively, are located. This is preferably the same angular relation in which the common axis of the motor 60 and the blades 72 of the muscle trainer 44 is mounted with respect to the shaft 54 thereof. With this angular relationship, the muscle trainer 108 will provide a linear pulling force in the direction of the arrow 102 (FIGS. 6 and 14), which is comparable to the linear pulling force provided by the muscle trainers 44 and 104. Therefore, this linear-pulling-force feature of the muscle trainer 108 provides the opportunity for the golfer 30 to use the muscle trainer 108 to exercise the front-of-the-plane muscles and the behind-the-plane muscles in the same manner described above with respect to the muscle trainers 44 and 104.

In addition, with the second straight section 118 of the shaft 110 of the muscle trainer 108 being offset by ninety degrees from the first straight section 116 (grip section), significant rotational forces are generated as the blades 142 are rotated by the motor 126. The rotational forces generated by the rotating blades 142 are represented in FIG. 14 by a rotating-arrows symbol 146.

Figure 16:
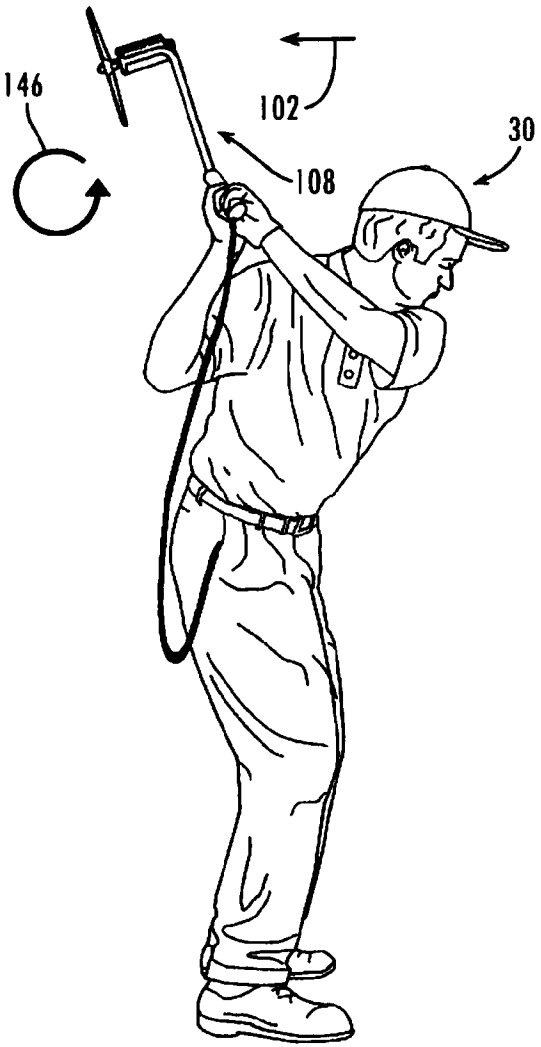
FIG. 16 is a side perspective view showing the right side of the golfer of FIG. 1 in the backswing-completion position of FIG. 1 while gripping the muscle trainer of FIG. 12 in the process of a muscle training exercise.
Figure 15:
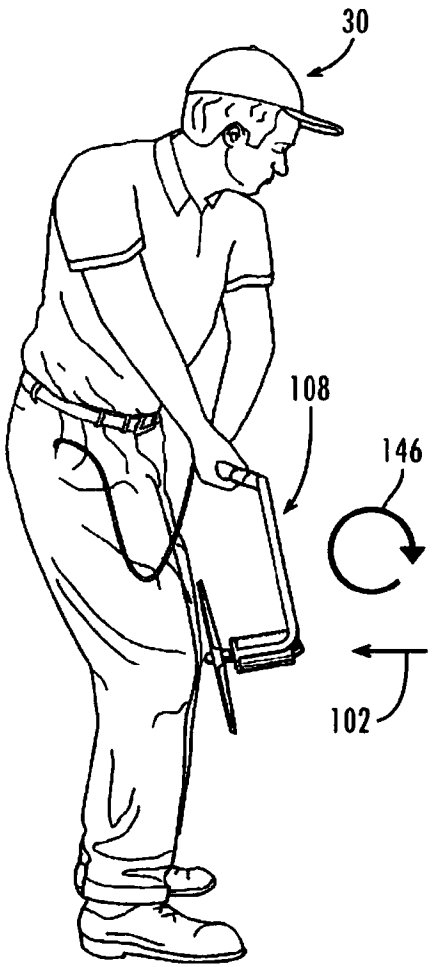
FIG. 15 is a side perspective view showing the golfer of FIG. 1 in a nine o'clock position, relative to the six o'clock position of FIG. 14, while gripping the muscle trainer of FIG. 12 in the process of a muscle training exercise.
Figure 14:
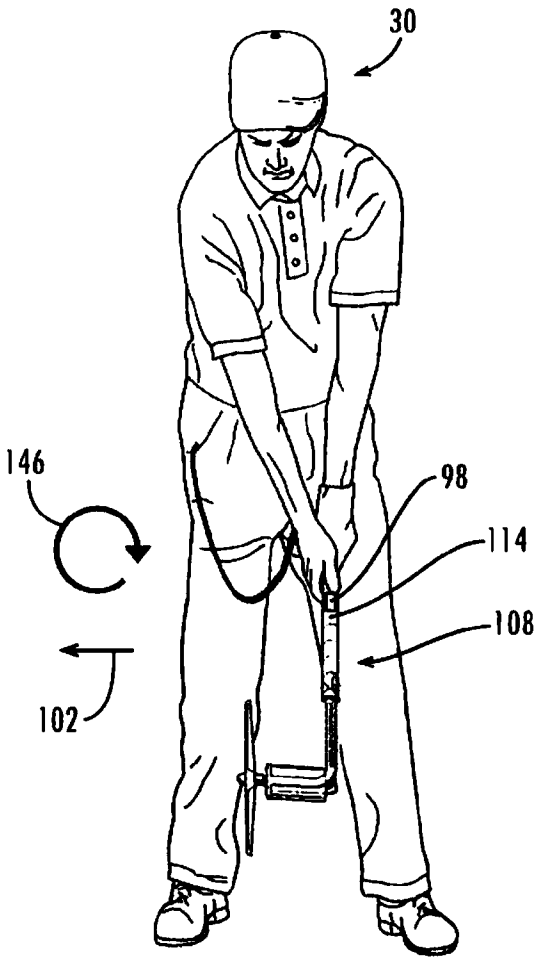
FIG. 14 is a front perspective view showing the golfer of FIG. 1 gripping the embodiment of the muscle trainer of FIG. 12, with the muscle trainer in a six o'clock position in preparation for a muscle training exercise.

Referring to FIGS. 14, 15 and 16, when using the muscle trainer 108, the golfer 30 grasps the grip 114 in the conventional golf-gripping manner, depresses the push-button switch 98 and proceeds with a non-stop backswing, or the step-and-stall motions, to process through an exercise cycle in the same manner as described above with respect to the use of the muscle trainer 44. During the exercise cycle, the front-of-the-plane muscles and the behind-the-plane muscles are exercised in the manner described above. Also, the rotational opposing muscle group is stressed by the rotational forces generated by the effect of the rotating blades 142 being offset from the axis of the first straight section 116. Thus, the rotational opposing muscle group is exercised by the golfer's reactionary efforts in response to the rotational forces.

For a right-handed golfer with over action of clockwise rotational muscles during the backswing, the club face would be in a closed position at the backswing completion position.

To achieve two-plane-merger in this situation, the dominated counter-clockwise rotational muscles must be exercised in a more strenuous fashion than the dominating clockwise rotational muscles. This would require that the propeller generate a clockwise rotational force on the implement. Likewise, if there is over action of the counter-clockwise rotational muscles, the propeller would be set to generate a counter-clockwise rotational force on the implement.

With dedicated exercising use of the muscle trainers 44 and 108 over a period of time, the golfer 30 will obtain a proper club shaft plane, proper hinging, and proper rotational muscle memory to the extent that the action of the hands, wrists and arms can be thought of as being on automatic pilot. This allows the golfer 30 to easily concentrate on other essentials such as swing speed, swing arc, keeping the golfer's weight from shifting to the outside of the golfer's right foot (if the golfer is right handed) or outside the golfer's left foot (if the golfer is left handed), and driving the downswing with the larger muscles of the torso.

As shown in FIGS. 12 and 13, the motor 126 and the blade assembly 140 are located to one side of an imaginary common plane which passes through the first straight section 116 and the second straight section 118. With this arrangement, the axis of the motor 126 and the blade assembly 140 extends perpendicularly from the common plane.

Other arrangements could be employed where the motor and the blades do not extend fully to one side of the common plane, but the axis of the motor and the blades continues to be perpendicular to the common plane. For example, with reference to FIG. 13, the pad 112 could be formed at a distal end of the straight section 118, in place of the illustrated junction 124, to form a distal end of the shaft 110. In this arrangement, the pad 112 would be in the common plane. The motor 126 would be mounted on one side of the pad 112, and thereby on one side of the common plane, and the blades 142 would be located on the other side of the pad, and thereby on the other side of the common plane, with the axis of the motor and the blades being perpendicular to the common plane. This assembly of the pad 112, the motor 126 and the blades 142 would then resemble the assembly of the pad 56, the motor 60 and the blades 72, respectively, at the distal end of shaft 54, as shown in FIG. 4.

Figure 11:
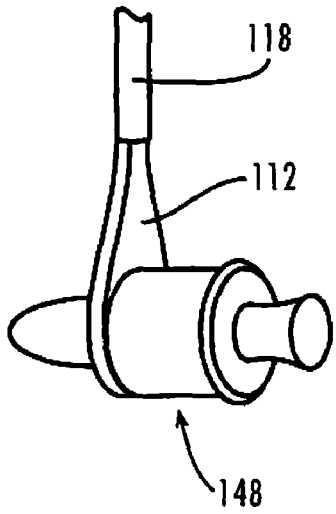
FIG. 11 is a partial perspective view showing a motor which can be used in place of the motor of FIG. 5, in accordance with an alternative embodiment of the invention.
Figure 11:
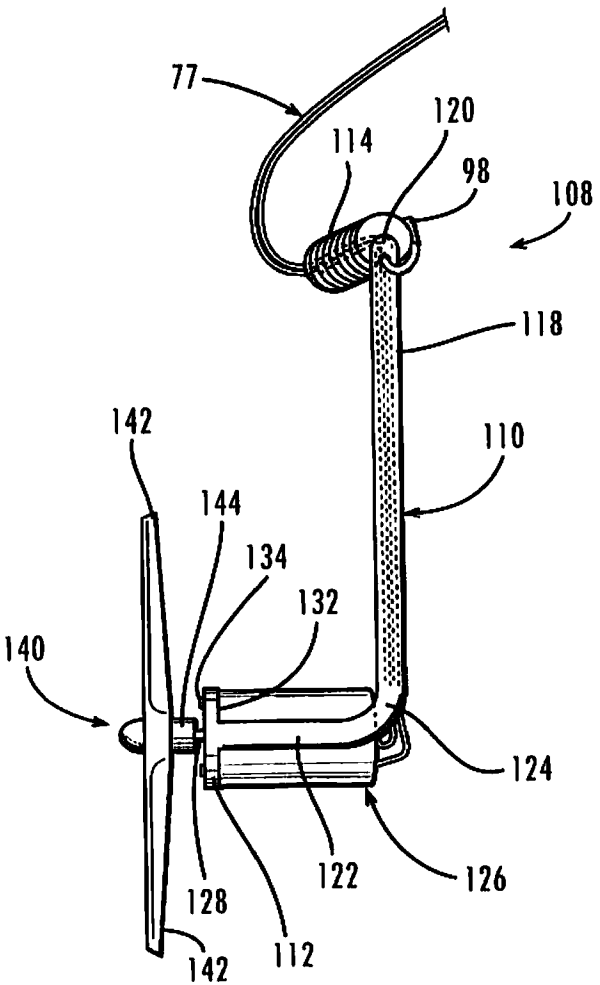
Figure 19:
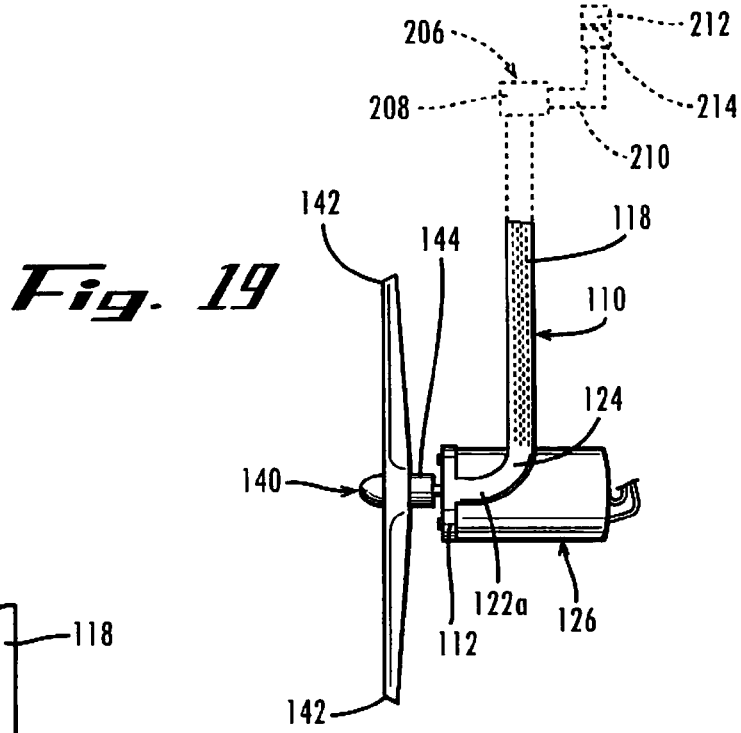
FIG. 19 is a partial side view showing a first modified version of the muscle trainer of FIG. 13 in accordance with an alternative embodiment of the invention.
Figure 20:
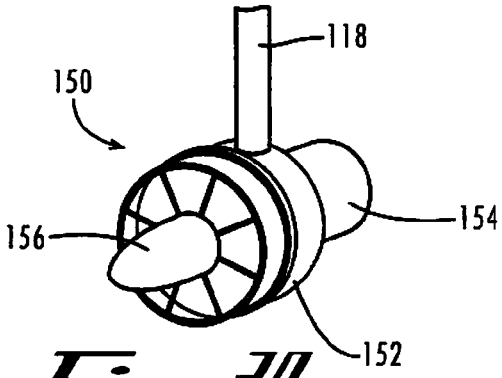
FIG. 20 is a partial side view showing a second modified version of the muscle trainer of FIG. 13 in accordance with an alternative embodiment of the invention.

Other arrangements, in which the force generator is perpendicular to the common plane, are illustrated in FIGS. 11, 19 and 20. As shown in FIG. 11, a jet engine 148, of the type typically used with model airplanes, is mounted on the pad 112, where the pad is located at the distal end of the straight section 118 of the muscle trainer 108 as modified in the manner described above. In this arrangement, the jet engine 148 forms a force generator.

As shown in solid view in FIG. 19, the muscle trainer 108 has been modified to replace the straight section 122 (FIG. 13) with a shorter straight section 122*a* of the shaft 110, which is also located in the common plane, whereby the motor 126 straddles the common plane and the common axis of the motor and the blades 142 are perpendicular to the common plane.

Referring to FIG. 20, the muscle trainer 108 has been modified to replace the motor 126 and the fan blade assembly 140 with an integral assembly 150. The integral assembly 150 includes a shroud 152 having an enclosed side wall with axial openings at opposite ends thereof. A motor 154 is mounted partially within the shroud 152 and extends from a first of the axial openings thereof. A fan blade assembly 156 is mounted on a shaft of the motor 154 and is contained within the shroud 152 adjacent a second of the axial openings thereof. The combination of the motor 154 and the fan blade assembly 156 form a force generator.

In preparation for assembly with the integral assembly 150, the muscle trainer 108 is modified to the extent that the distal end of the straight section 118 is the distal end of the now padless shaft 110. As shown in FIG. 20, the distal end of the modified straight shaft 118 is connected directly to an outer surface of the shroud 152. Since the straight section 118 is in the common plane, the integral assembly 150 straddles the common plane and the common axis of the motor 154 and the fan blade assembly 156 is perpendicular to the common plane.

Figure 17:
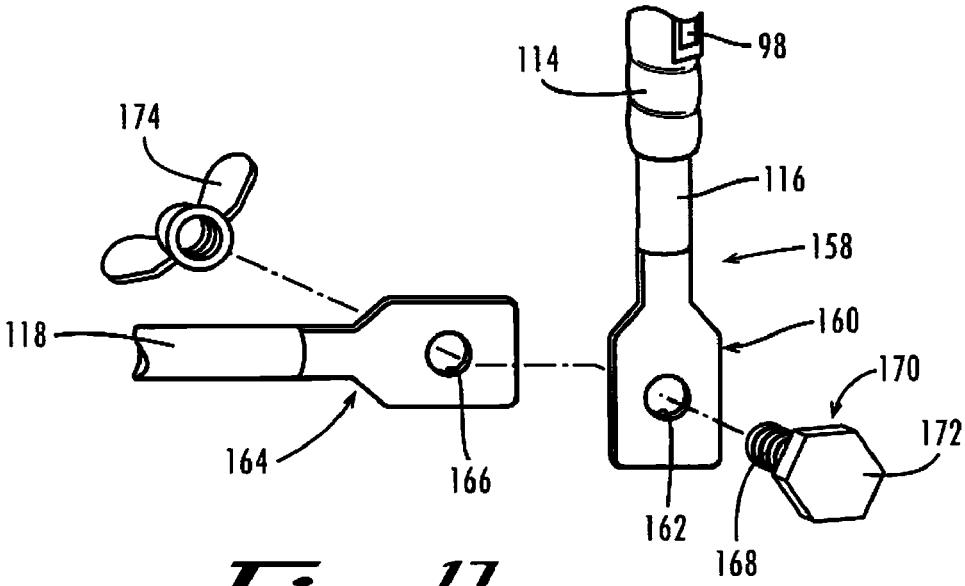
FIG. 17 is a partial exploded view showing a first facility for adjusting the relative position of a pulling force means with respect to the shaft of a preferred embodiment of the invention.

While the muscle trainer 108 provides for the mounting of the straight section 116 of the shaft 110 at an angle of ninety degrees with respect to the straight section 118, the golfer 30 may find more comfort and greater ease of exercising with an angle greater or less than ninety degrees between the sections 116 and 118. With that in mind, the muscle trainer 108 shown in FIG. 13 is modified by placing a first adjustment mechanism 158, as shown in FIG. 17, at the juncture 120 of the shaft 110.

In particular, the straight section 116 is separated from the straight section 118 at the juncture thereof to form adjacent free ends of the straight sections. The adjustment mechanism 158 includes a first connection member 160 which is attached to the free end of the straight section 116 and is formed with a flat portion having a hole 162 formed there through. The adjustment mechanism 158 further includes a second connection member 164 which is attached to the free end of the straight section 118 and is formed with a flat portion having a hole 166 formed there through. The flat portions are arranged into an overlapping assembly with the holes 162 and 166 in alignment. A threaded portion 168 of a bolt 170 is located through the aligned holes 162 and 166, while a head 172 prevents the bolt from being moved through the holes. A threaded fastener 174 is placed on the threaded portion 168 of the bolt 170 and tightened to retain the connection members 160 and 164 in assembly, and to connect and retain together the straight sections 116 and 118 of the shaft 110.

The fastener 174 can be loosened and the straight sections 116 and 118 manipulated to a perpendicular position or a non-perpendicular position selected by the golfer 30 and then retightened to secure the straight sections in the selected angular relationship. Since the straight sections 116 and 118 are located in the common plane, by using the muscle trainer 108 modified by the adjusting mechanism 158, the golfer 30 has the opportunity of selectively and adjustably locating the motor 126 and the fan blade assembly 140 in many different angular positions, including perpendicular and non-perpendicular, with respect to the distal end of the straight section 116, while maintaining the common axis of the motor 126 and the fan blade assembly 140 perpendicular to the common plane.

Figure 18:
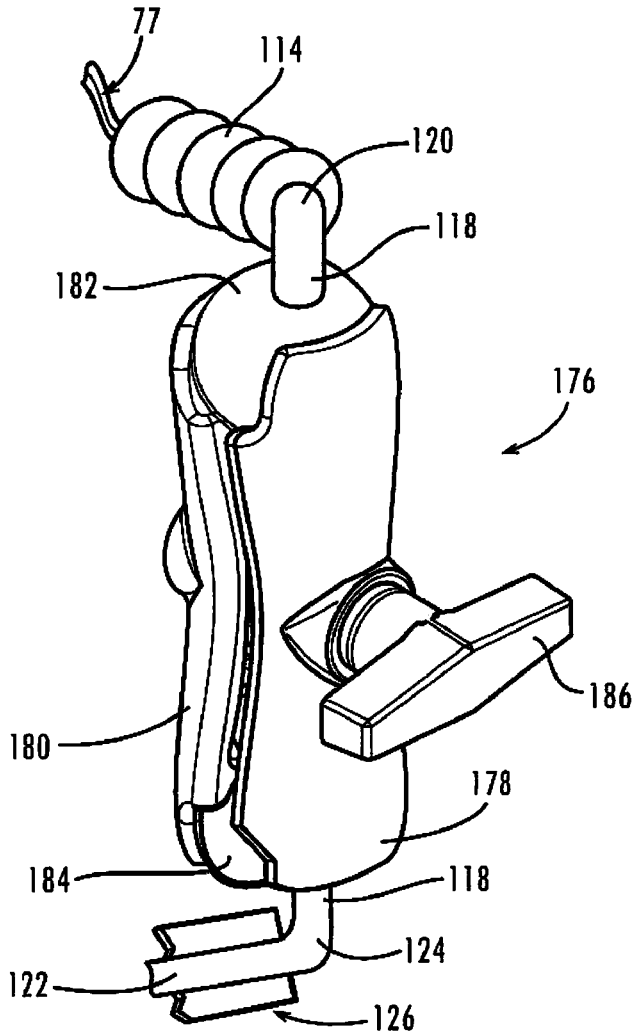
FIG. 18 is a partial perspective view showing a second facility for adjusting the relative position of the pulling force means with respect to the shaft of a preferred embodiment of the invention.

The muscle trainer 108 shown in FIGS. 12 and 13 can also be modified to accomplish the above-noted adjustability by replacing an intermediate portion of the straight section 118 of the shaft 110 with a second adjusting mechanism 176 as shown in FIG. 18. With this arrangement, a proximal portion of the straight section 118 remains adjacent the junction 120, and a distal portion of the straight section 118 remains adjacent the junction 124.

The adjusting mechanism 176 includes two half shells 178 and 180, which, when assembled together, generally assume a "peanut" shape with opposite open ends. Each of the half shells 178 and 180 is formed with a concave interior, which interfaces with the concave interior of the other shell when the shells are assembled together. Two spherical elements 182 and 184 are spatially located within, and at opposite ends of, the interior of the assembled half shells 178 and 180, and extend partially from a respective one of the open ends.

An adjusting knob 186 is located along an outer side of the half shell 178 and cooperates with a threaded member extending from the half shell 180 and through the assembled half shells. Selective manipulation of the knob 186 allows a slight separation, without disassembly, of the half shells 178 and 180 so that the spherical elements 182 and 184 can be adjustably manipulated while being retained within the assembled half shells. The knob 186 can then be adjusted to move the half shells 178 and 180 to a tightened position, whereby the spherical elements 182 and 184 are clamped between the half shells in their manipulated positions.

The second adjusting mechanism 176 is illustrated, described and referred to as "a split arm assembly" in U.S. Pat. No. 5,845,885, which issued on Dec. 8, 1998, to Jeffrey D. Carnevali. A split arm assembly, of the type described herein as the second adjusting mechanism 176, is available commercially from National Products Inc. of Seattle, Wash.

Referring again to FIG. 18, the remaining proximal portion of the straight section 118, which is joined with the juncture 120, is attached to the spherical element 182. Also, the remaining distal portion of the straight section 118, which is joined with the juncture 124, is attached to the spherical element 184.

If the golfer 30 wishes to adjust the angular relationship between the straight section 116 of the shaft 110 and the straight section 118 thereof, the knob 186 is manipulated to relax the retention of the two half shells 178 and 180. Thereafter, the spherical element 182 is manipulated to make the desired angular adjustment, and the knob 186 is again manipulated to draw the half shells 178 and 180 tightly together to retain the selected angular adjustment.

During the adjustment process, the spherical element 184 is not manipulated, whereby the common axis of the motor 126 and the fan blade assembly 140 is retained in the perpendicular relation with the common plane. This perpendicular relationship can be permanently maintained by securing the distal portion of the straight section 118 within the space occupied by the spherical element 184 between the half shells 178 and 180.

It is noted that the distal portion of the straight section 118 of the shaft 110 can be adjusted if desired. Such adjustment would shift the common axis of the motor 126 and the fan blade assembly 140 into a non-perpendicular alignment with the common plane. Also, an adjustment mechanism, such as the adjustment mechanism 158 of FIG. 17, could be located in place of the juncture 124 of the shaft 110 to provide adjustment of the common axis of the motor 126 and the fan blade assembly 140 into a non-perpendicular alignment with the common plane.

When the common axis of the motor 126 and the fan blade assembly 140 is located at a non-perpendicular angle with respect to the common plane, a vector component of the non-perpendicular angle will be perpendicular to the common plane. This vector component is referred to hereinafter as "the perpendicular vector component." The perpendicular vector component will result in a force generation component directed in the manner comparable to direction of the force generation described above with respect to the non-adjustable muscle trainer 108 as shown in FIGS. 12 and 13. Thus, the golfer 30 will be able to maintain an exercise regimen comparable to that described above with respect to the non-adjustable muscle trainer 108.

In addition, other vector components of force generation are present when the common axis of the motor 126 and the fan blade assembly 140 are non-perpendicular with respect to the common plane. These vector components are referred to hereinafter as "the non-perpendicular vector components." The non-perpendicular vector components will result in force generation components which allow the golfer 30 to laterally extend the benefits of exercising of the club shaft plane muscle group, the rotational muscle group, and the hinge muscle group thereby further enhancing the sculpting of these muscles.

Figure 21:
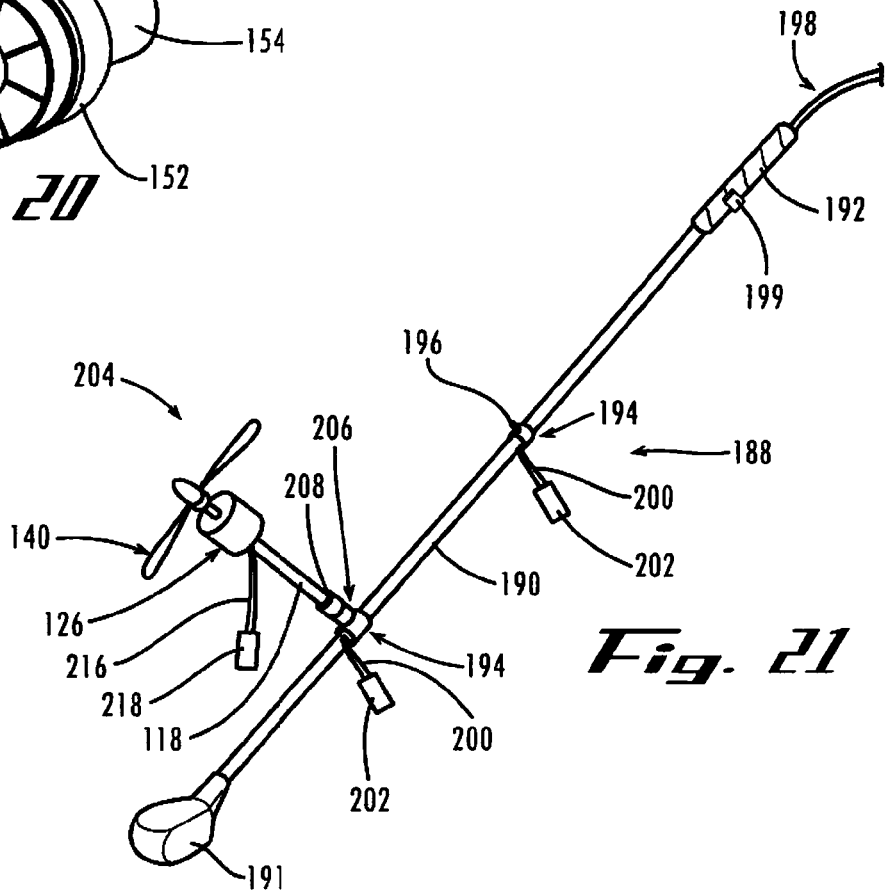
FIG. 21 is a side view of a conventional golf club, referred to as a driver, which has been modified to be used as a muscle trainer, in accordance with an alternative embodiment of the invention.

As depicted in FIG. 21, an alternative embodiment of the invention includes a conventional golf club, such as a driver 188, that has been modified to provide facility for muscle training in a manner similar to the muscle trainers 44, 104 and 108, and the various above-described modified versions thereof. In particular, the modified driver 188 includes a hollow shaft 190, a club head 191 at a distal end thereof, and a grip 192 at a proximal end thereof, all in a conventional manner. The length of hollow shaft 190 could be varied and club head 191 could be changed to produce a replica of any type of golf club. At least one support ring 194 is secured to a selected portion of the shaft 190, with each ring including a threaded stud 196 extending away from the shaft. Although two support rings 194 are illustrated in FIG. 21, the number and orientation of the support rings can be varied to produce any desired force vector or combination of force vectors on modified driver 188.

The proximal end of the shaft 190 is formed with an opening (not shown) to facilitate insertion of a distal portion of a main wiring assembly 198 into an axial opening of the hollow shaft, with the main wiring assembly being connectable to a power source, such as the battery pack 90 described above. A push-button switch 199 is attached to the grip 192 and is connected to the main wiring assembly 198 in the manner described above with respect to the push-button switch 98.

Preferably, at least one small opening is formed through intermediate portions of the shaft 190, with each opening being located adjacent to the at least one respective support ring 194. At least one short wiring assembly 200 is connected at an internal end thereof, internally of the shaft, to the main wiring assembly 198, and extends outward through the at least one small opening. An external end of the at least one short wiring assembly 200 is connected to at least one connector 202.

As shown in FIG. 21, at least one motor and fan blade assembly 204 is attached to the modified driver 188. Although only one motor and fan assembly is shown, it is possible to attach more than one such assembly to produce an infinite number of combined force vectors on modified driver 188. The motor and fan blade assembly 204, which is essentially the same as the assembly of the motor 126 and the fan blade assembly 140 as shown in solid in FIG. 19, includes the shaft section 118, a distal portion of which is shown in FIG. 19 in solid and a proximal portion of which is shown in dashed line.

As further shown in dashed line in FIG. 19, the motor and fan blade assembly 204 includes a connection member 206 formed with a band 208, which is attached to a proximal end of the shaft section 118. An arm 210 extends integrally from the band 208, and a coupling pad 212 is formed integrally with the arm. The coupling pad 212 is formed with a hole 214 there through which is positionable selectively over the at least one threaded stud 196, as shown in FIG. 21, which extends from the at least one support ring 194 mounted spatially on the shaft 190 of the driver 188. As shown in FIG. 21, a short wiring assembly 216 is connected at one end thereof to the motor 126, and at an opposite end thereof to a connector 218, which is designed to be connectable to the at least one connector 202.

When the golfer 30 desires to use the modified driver 188 in a muscle training mode, the golfer places the hole 214 of the coupling pad 212 over the threaded stud 196 of the at least one support ring 194, which is attached to the shaft 190 of the driver. A threaded fastener is then placed on the stud 196 and tightened against the coupling pad 212 to secure the motor and fan blade assembly 204 to the modified driver 188. The main wiring assembly 198 is connected to the battery pack.

The golfer 30 then uses the modified driver 188 in the manner described above with respect to the use of muscle trainers 44, 104, or 108 to exercise the club shaft plane muscle group, the rotational muscle group, and the hinge muscle group in accordance with the principles of the invention described hereinabove.

While various force generators (i.e., the motors 60, 126 and 154, and their respective blade assemblies, and the jet engine 148) have been described above for use with respective ones of the various muscle trainers 44, 104, 108, and 188, it is to be understood that any of the above-described force generators could be used with any of the various muscle trainers without departing from the spirit and scope of the invention.

FIG. 23 depicts an embodiment of the muscle trainer 44 which includes multiple force generators for generating forces in multiple directions relative to the shaft 54*a* of the muscle trainer. This embodiment includes a first motor 60*a* and blade assembly 70*a* for generating force in a first direction, a second motor 60*b* and blade assembly 70*b* for generating force in a second direction, and a third motor 60*c* and blade assembly 70*c* for generating force in a third direction. In the embodiment shown in FIG. 23, the first direction is substantially parallel with the club shaft plane and perpendicular to the shaft 54*a*, and the second direction is substantially perpendicular to the club shaft plane and the shaft 54*a*. The force in the third direction is a rotational force about the shaft 54*a*. The first motor 60*a* is preferably disposed at the end of the shaft 54*a*. The second motor 60*b* is preferably disposed in a central portion of the shaft 54*a*. The third motor 60*c* is preferably disposed on a shaft 54*b* which is connected to and extends outward from the shaft 54*a*.

In summary, with dedicated exercising use by a golfer of any of the above-described muscle trainers 44, 104, 108, or 188 over a period of time, the golfer will attain balanced muscle tone and memory of the club shaft plane muscle group leading to a proper club shaft plane. With dedicated exercising use of the muscle trainers 44, 104, or 188 over a period of time, the golfer will attain enhanced hinge muscle group memory leading to proper hinging. Further, with dedicated exercising use of the muscle trainers 108 or 188 over a period of time, the golfer will also attain enhanced rotational muscle memory leading to proper rotation of the club face plane throughout the swing. With the attainment of these attributes, the action of the hands, wrists and arms in subsequent golf swings by the golfer, during the playing of the game of golf, can be thought of as being on automatic pilot. This allows the golfer to easily concentrate on other essentials such as swing speed, swing arc, keeping the golfer's weight from shifting to the outside of the right foot, if the golfer is right handed, or outside the left foot, if the golfer is left handed, and driving the downswing with the larger muscles of the torso.

The game of golf, and particularly the swinging of a golf club in playing the game of golf, has been used above as a centerpiece to describe the principles of the invention covered herein, as practiced by the use of the various embodiments and versions of the above-described muscle trainers, and the methods of exercising. However, the muscle trainers, and the methods of exercising, described above can also be used to enhance the muscle memory associated with other sports games and activities. For example, games such as baseball, softball, tennis, racket ball, weight lifting and weight throwing involve action between competing muscles to obtain balance and direction in the particular sports endeavor. Indeed, the muscle trainers, and the methods of exercising, described above can be used in many walks of life unrelated to sports games. For example, the swinging and directing of a maul, a hammer or an axe into engagement with a target object requires separate muscle groups.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally, and equitably entitled.

What is claimed is:

1. A muscle trainer for exercising rotational muscles used by a person in gripping and moving an implement in performance of a useful or recreational function, wherein if the rotational muscles were of appropriate strength, the rotational muscles would desirably apply appropriate rotational forces to the implement to maintain desired rotation of the implement as the implement is gripped and moved by the person, the muscle trainer thereby training the rotational muscles to consistently maintain desired rotation of the implement during performance of the useful or recreational function, the muscle trainer comprising:

a body having a first section extending in a first axial direction and a second section joined to the first section at a juncture, the second section extending in a second axial direction that is different from the first axial direction; and a force generator located on the second section and positioned for urging the second section of the body in a third direction which is different from the second axial direction, thereby creating a rotational force about the first axial direction.

2. The muscle trainer as set forth in claim 1 further comprising a coupler for coupling the first and second sections together at the juncture of the first and second sections, wherein the first section is adjustably coupled by the coupler to the second section so that the first and second sections can be located selectively in different angular positions relative to each other.

3. The muscle trainer as set forth in claim 1, wherein the first section of the body and the second section of the body each comprise a shaft, and the muscle trainer further comprises a grip surface on the shaft of the first section of the body.

4. The muscle trainer as set forth in claim 3, wherein the force generator generates a force at an angle with respect to the shaft of the second section of the body.

5. The muscle trainer as set forth in claim 1, wherein the force generator comprises:

a motor attached to the second section of the body; and a propeller attached to the motor in such a position that, upon operation of the motor, the propeller is operated to urge the second section of the body in the third direction.

6. The muscle trainer as set forth in claim 5 further comprising a control device for selectively controlling one or more of the speed and direction of rotation of the motor.

7. The muscle trainer as set forth in claim 6 further comprising a remote control device, wherein the control device is located on the remote control device so that the control device may be operated from a position which is separate from the muscle trainer and the person using the muscle trainer.

8. The muscle trainer as set forth in claim 1, wherein the force generator comprises a device for developing a pressurized media and for discharging the pressurized media from the device.

9. The muscle trainer as set forth in claim 8 wherein the device for developing a pressurized media comprises a motor and blade assembly.

10. The muscle trainer as set forth in claim 8 wherein the device for developing a pressurized media comprises a jet engine.

11. The muscle trainer as set forth in claim 1, wherein the body has a shape and a weight distribution configured to simulate the shape and weight distribution of an implement selected from the group consisting of golf clubs, baseball bats, softball bats, tennis rackets, racket ball rackets, mauls, axes and hammers.

12. A muscle trainer for exercising one or more muscles in one or more groups of two or more opposing muscles used by a person in gripping and moving an implement in performance of a useful or recreational function, wherein if the two or more opposing muscles were of appropriate strength, the two or more opposing muscles would desirably apply appropriate forces in substantially opposite directions to maintain the implement in a desired movement path as the implement is gripped and moved by the person, the muscle trainer thereby training the two or more opposing muscles to consistently maintain the implement in a desired movement path during performance of the useful or recreational function, the muscle trainer comprising:

a body having a first section extending in a first axial direction and a second section joined to the first section at a juncture, the second section extending in a second axial direction;

and one or more force generators located on one or more of the first and second sections for creating one or more forces in opposition to the forces applied by the one or more muscles in the movement of the muscle trainer by the person, wherein at least one of the one or more force generators includes a device for discharging a pressurized media, wherein the one or more forces created by the one or more force generators are created independently of any force created due to movement of the muscle trainer by the person, and wherein the muscle trainer is free of projections or structures that extend outward from the first section of the body which interfere with a wrist or arm of the person as the person holds the body with at least one hand and moves the muscle trainer.

13. The muscle trainer of claim 12 wherein the one or more force generators create one or more forces at an angle relative to a swing plane, in which plane a swing plane opposing muscle group controls a swinging movement of the first section of the body.

14. The muscle trainer of claim 12 wherein the one or more force generators create one or more rotational forces relative to the first axial direction of the first section of the body, in which direction a rotational opposing muscle group controls a rotational movement of the first section of the body.

15. The muscle trainer of claim 12 wherein the one or more force generators create one or more forces within a hinging plane, in which plane a hinge opposing muscle group controls a hinging movement of the first section of the body.

16. The muscle trainer as set forth in claim 12 further comprising a coupler for coupling the first and second sections together at the juncture of the first and second sections, wherein the first section is adjustably coupled by the coupler to the second section so that the first and second sections can be selectively positioned to allow adjustment of an angular relationship between the first axial direction and the second axial direction.

17. The muscle trainer as set forth in claim 12, wherein the first section of the body and the second section of the body each comprise a shaft, and the muscle trainer further comprises a grip surface on the shaft of the first section of the body.

18. The muscle trainer as set forth in claim 12, wherein the one or more force generators generate one or more forces at an angle with respect to one or more of the first and second axial directions.

19. The muscle trainer as set forth in claim 12, wherein the one or more force generators comprise:

one or more motors attached to one or more of the first and second sections of the body; and one or more propellers attached to the one or more motors in such a position that, upon operation of the one or more motors, the one or more propellers create the one or more forces relative to the first axial direction in opposition to the one or more forces applied by the one or more muscles of the one or more opposing muscle groups in the movement of the muscle trainer by the person.

20. The muscle trainer as set forth in claim 19 further comprising a control device for selectively controlling one or more of the speed and direction of rotation of the one or more motors.

21. The muscle trainer as set forth in claim 20 further comprising a remote control device, wherein the control device is located on the remote control device so that the control device may be operated from a position which is separate from the muscle trainer and the person using the muscle trainer.

22. The muscle trainer as set forth in claim 12 wherein the device for developing a pressurized media comprises one or more motors and blade assemblies.

23. The muscle trainer as set forth in claim 12 wherein the device for developing a pressurized media comprises one or more jet engines.

24. The muscle trainer as set forth in claim 12, wherein the body has a shape and a weight distribution configured to simulate the shape and weight distribution of an implement selected from the group consisting of golf clubs, baseball bats, softball bats, tennis rackets, racket ball rackets, mauls, axes and hammers.

* * * * *